US012359144B2

(12) United States Patent
Sunahara et al.

(10) Patent No.: US 12,359,144 B2
(45) Date of Patent: Jul. 15, 2025

(54) LUBRICANT COMPOSITION

(71) Applicant: IDEMITSU KOSAN CO., LTD., Chiyoda-ku (JP)

(72) Inventors: Kenji Sunahara, Chiyoda-ku (JP); Shoichiro Fujita, Chiyoda-ku (JP); Masaya Kubota, Chiyoda-ku (JP)

(73) Assignee: IDEMITSU KOSAN CO., LTD., Chiyoda-ku (JP)

( * ) Notice: Subject to any disclaimer, the term of this patent is extended or adjusted under 35 U.S.C. 154(b) by 0 days.

(21) Appl. No.: 18/552,839

(22) PCT Filed: Mar. 17, 2022

(86) PCT No.: PCT/JP2022/012202
§ 371 (c)(1),
(2) Date: Sep. 27, 2023

(87) PCT Pub. No.: WO2022/209942
PCT Pub. Date: Oct. 6, 2022

(65) Prior Publication Data

US 2024/0199972 A1 Jun. 20, 2024

(30) Foreign Application Priority Data

Mar. 31, 2021 (JP) ..... 2021-062417

(51) Int. Cl.

| | |
|---|---|
| ***C10M 157/10*** | (2006.01) |
| ***C10M 135/18*** | (2006.01) |
| ***C10M 159/18*** | (2006.01) |
| ***C10M 163/00*** | (2006.01) |
| *C10N 40/25* | (2006.01) |

(52) U.S. Cl.
CPC ..... *C10M 157/10* (2013.01); *C10M 135/18* (2013.01); *C10M 159/18* (2013.01); *C10M 163/00* (2013.01); *C10M 2219/068* (2013.01); *C10M 2227/066* (2013.01); *C10N 2040/25* (2013.01)

(58) Field of Classification Search
CPC C10M 157/10; C10M 135/18; C10M 159/18; C10M 163/00; C10M 2219/068; C10M 2227/066; C10M 2203/1006; C10M 2205/02; C10M 2209/084; C10M 2215/223; C10M 2215/28; C10M 2219/046; C10M 2223/045; C10N 2040/25; C10N 2010/12; C10N 2030/02; C10N 2030/04; C10N 2030/06; C10N 2030/10; C10N 2030/12
See application file for complete search history.

(56) References Cited

U.S. PATENT DOCUMENTS

| | | | | |
|---|---|---|---|---|
| 5,906,969 | A * | 5/1999 | Fyfe | C10M 133/56 508/364 |
| 6,074,993 | A | 6/2000 | Waddoups et al. | |
| 2009/0203561 | A1* | 8/2009 | Kamano | C10M 163/00 508/362 |
| 2016/0304802 | A1 | 10/2016 | Tamura et al. | |
| 2016/0348027 | A1 | 12/2016 | Utaka | |
| 2019/0024009 | A1 | 1/2019 | Kusumoto et al. | |

(Continued)

FOREIGN PATENT DOCUMENTS

| | | |
|---|---|---|
| EP | 3 101 097 A1 | 12/2016 |
| EP | 3 279 299 A1 | 2/2018 |

(Continued)

OTHER PUBLICATIONS

International Search Report issued on May 31, 2022 in PCT/JP2022/012202 (with English translation), 5 pages.

(Continued)

*Primary Examiner* — Cephia D Toomer
(74) *Attorney, Agent, or Firm* — Oblon, McClelland, Maier & Neustadt, L.L.P.

(57) ABSTRACT

An object of the present invention is to provide a lubricating oil composition which, even while exhibiting an excellent friction reducing effect by combining plural types of molybdenum-based friction modifiers, has excellent high-temperature detergency, oxidation stability and copper corrosion resistance. The object has been achieved by a lubricating oil composition containing a base oil (A), a molybdenum-based friction modifier (B), a metal-based detergent (C), and an ash-free dispersant (D), wherein the molybdenum-based friction modifier (B) contains two or more selected from the group consisting of a binuclear molybdenum dithiocarbamate (B1), a trinuclear molybdenum dithiocarbamate (B2), and a molybdenum-amine complex (B3); the metal-based detergent (C) contains a sulfur atom; the ash-free dispersant (D) contains a nitrogen atom; the acid value derived from the binuclear molybdenum dithiocarbamate (B1) and the trinuclear molybdenum dithiocarbamate (B2) is less than 0.04 mgKOH/g; the content ratio of a sulfur content ($C_S$) derived from the metal-based detergent (C) to a nitrogen content ($D_N$) derived from the ash-free dispersant (D), [$(C_S)/(D_N)$] is 0.30 to 0.85 in terms of the mass ratio; and the phosphorus content based on the total amount of the lubricating oil composition is more than 0.04% by mass and less than 0.10% by mass.

20 Claims, No Drawings

(56) References Cited

U.S. PATENT DOCUMENTS

| | | | | |
|---|---|---|---|---|
| 2019/0106648 | A1 | 4/2019 | Kusumoto et al. | |
| 2022/0403284 | A1* | 12/2022 | Jones | C10M 141/10 |

FOREIGN PATENT DOCUMENTS

| | | | |
|---|---|---|---|
| EP | 3 950 905 | A1 | 2/2022 |
| JP | 2015-140354 | A | 8/2015 |
| JP | 2017-149830 | A | 8/2017 |
| WO | WO 2015/076417 | A1 | 5/2015 |
| WO | WO 2017/002969 | A1 | 1/2017 |
| WO | WO 2017/170948 | A1 | 10/2017 |
| WO | WO 2020/203524 | A1 | 10/2020 |

OTHER PUBLICATIONS

Written Opinion issued on May 31, 2022 in PCT/JP2022/012202 (with English translation), 6 pages.
Extended European Search Report issued Feb. 24, 2025 in European Patent Application No. 22780162.8 5 pgs.

* cited by examiner

LUBRICANT COMPOSITION

CROSS REFERENCE TO RELATED APPLICATIONS

This application is a National Stage entry under 35 U.S.C. § 371 of PCT/JP2022/012202, filed on Mar. 17, 2022, and claims priority to Japanese Patent Application No. 2021-062417, filed on Mar. 31, 2021, the entire contents of which are incorporated herein by reference.

TECHNICAL FIELD

The present invention relates to a lubricating oil composition.

BACKGROUND ART

In recent years, lubricating oil compositions used in internal combustion engines such as engines are required to have further improved fuel saving properties. For this reason, the viscosity of lubricating oil compositions has been reduced, and research on molybdenum-based friction modifiers has been progressing from the viewpoint of exhibiting a higher friction reducing effect.

As a molybdenum-based friction modifier, for example, binuclear molybdenum dithiocarbamate and trinuclear molybdenum dithiocarbamate are known (see, for example, PTL 1).

CITATION LIST

Patent Literature

PTL 1: WO 2017/002969 A

SUMMARY OF INVENTION

Technical Problem

In recent years, there has been a demand for further improvement in a friction reducing effect. Therefore, it is conceivable to further improve the friction reducing effect by using a combination of plural types of molybdenum-based friction modifiers.

However, as a result of intensive studies by the present inventors, it has been found that the high-temperature detergency and oxidation stability of a lubricating oil composition deteriorates when the inventors attempt to further improve the friction-reducing capability by combining plural types of molybdenum-based friction modifiers. In addition, it has been found that the copper corrosion resistance of the lubricating oil composition also deteriorates. The lubricating oil composition with poor copper corrosion resistance may accelerate deterioration due to copper elution into oils due to corrosion of copper-based members used in internal combustion engines such as engines.

The present invention has been made in view of such problems, and an object of the present invention is to provide a lubricating oil composition which, even while exhibiting an excellent friction reducing effect by combining plural types of molybdenum-based friction modifiers, has excellent high-temperature detergency, oxidation stability and copper corrosion resistance.

In the present description, "copper corrosion resistance" means that even when a copper-based member is corroded, copper elution into oil is unlikely to occur.

Solution to Problem

In order to solve the above problems, the present inventors have made intensive studies and have found the following configuration [1].

That is, the present invention relates to the following [1] to [4].

[1] A lubricating oil composition containing a base oil (A), a molybdenum-based friction modifier (B), a metal-based detergent (C), and an ash-free dispersant (D), wherein the molybdenum-based friction modifier (B) contains two or more selected from the group consisting of a binuclear molybdenum dithiocarbamate (B1), a trinuclear molybdenum dithiocarbamate (B2), and a molybdenum-amine complex (B3), the metal-based detergent (C) contains a sulfur atom, the ash-free dispersant (D) contains a nitrogen atom, an acid value derived from the binuclear molybdenum dithiocarbamate (B1) and the trinuclear molybdenum dithiocarbamate (B2) is less than 0.04 mgKOH/g, a content ratio of a sulfur content ($C_S$) derived from the metal-based detergent (C) to a nitrogen content ($D_N$) derived from the ash-free dispersant (D), $[(C_S)/(D_N)]$ is 0.30 to 0.85 in terms of mass ratio, and a phosphorus content based on a total amount of the lubricating oil composition is more than 0.04% by mass and less than 0.10% by mass.

[2] An internal combustion engine containing the lubricating oil composition according to the above [1].

[3] A method of lubricating an internal combustion engine using the lubricating oil composition according to the above [1].

[4] A method of producing a lubricating oil composition, including a step of mixing a base oil (A), a molybdenum-based friction modifier (B), a metal-based detergent (C), and an ash-free dispersant (D), wherein the molybdenum-based friction modifier (B) contains two or more selected from the group consisting of a binuclear molybdenum dithiocarbamate (B1), a trinuclear molybdenum dithiocarbamate (B2), and a molybdenum-amine complex (B3), the metal-based detergent (C) contains a sulfur atom, the ash-free dispersant (D) contains a nitrogen atom, an acid value derived from the binuclear molybdenum dithiocarbamate (B1) and the trinuclear molybdenum dithiocarbamate (B2) is less than 0.04 mgKOH/g, a content ratio of a sulfur content ($C_S$) derived from the metal-based detergent (C) to a nitrogen content ($D_N$) derived from the ash-free dispersant (D), $[(C_S)/(D_N)]$ is adjusted to be 0.30 to 0.85 in terms of mass ratio, and a phosphorus content based on a total amount of the lubricating oil composition is adjusted to be more than 0.04% by mass and less than 0.10% by mass.

Advantageous Effects of Invention

According to the present invention, it is possible to provide a lubricating oil composition which, even while exhibiting an excellent friction reducing effect by combining plural types of molybdenum-based friction modifiers, has excellent high-temperature detergency, oxidation stability and copper corrosion resistance.

DESCRIPTION OF EMBODIMENTS

Upper limits and lower limits of numerical ranges described in the present description can be arbitrarily combined. For example, when "A to B" and "C to D" are described as numerical ranges, the numerical ranges "A to D" and "C to B" are also included in the scope of the present invention.

Moreover, the numerical range "a lower limit to an upper limit" described in the present description means the lower limit or more and the upper limit or less, unless otherwise specified.

In addition, in the present description, numerical values in Examples are numerical values that can be used as the upper limit or the lower limit.

[Embodiment of Lubricating Oil Composition]

A lubricating oil composition of the present embodiment contains a base oil (A), a molybdenum-based friction modifier (B), a metal-based detergent (C), and an ash-free dispersant (D).

The molybdenum-based friction modifier (B) contains two or more selected from the group consisting of a binuclear molybdenum dithiocarbamate (B1), a trinuclear molybdenum dithiocarbamate (B2), and a molybdenum-amine complex (B3).

The metal-based detergent (C) contains a sulfur atom.

The ash-free dispersant (D) contains a nitrogen atom.

The acid value derived from the binuclear molybdenum dithiocarbamate (B1) and the trinuclear molybdenum dithiocarbamate (B2) is less than 0.04 mgKOH/g.

The content ratio of the sulfur content ($C_S$) derived from the metal-based detergent (C) to the nitrogen content ($D_N$) derived from the ash-free dispersant (D), $[(C_S)/(D_N)]$ is 0.30 to 0.85 in terms of mass ratio.

The phosphorus content based on the total amount of the lubricating oil composition is more than 0.04% by mass and less than 0.10% by mass.

The present inventors have made intensive studies to further improve the friction-reducing capability by using a combination of plural types of molybdenum-based friction modifiers. As a result, it has been found that although the use of a combination of plural types of molybdenum-based friction modifiers improves the friction reducing effect, the use deteriorates oxidation stability, high-temperature detergency, and copper corrosion resistance. In other words, it has been found that when using a combination of plural types of molybdenum-based friction modifiers, it is difficult to improve all of oxidation stability, high-temperature detergency, and copper corrosion resistance.

Therefore, in order to create a lubricating oil composition that can improve all of oxidation stability, high-temperature detergency, and copper corrosion resistance even when using a combination of plural types of molybdenum-based friction modifiers, the present inventors have conducted intensive studies from both an approach to molybdenum-based friction modifiers and an approach to the balance of additives blended in the lubricating oil composition.

As a result, above problems have been solved by using a combination of specific molybdenum-based friction modifiers, by adjusting the acid value of the molybdenum-based friction modifiers to a specific range, by adjusting the content ratio of the sulfur content derived from the metal-based detergent and the nitrogen content derived from the ash-free detergent to a specific range, and by adjusting the phosphorus content of the lubricating oil composition to a specific range.

Although the mechanism by which the effect of the present invention is exhibited is not clear, it is presumed that, with respect to a combination of specific molybdenum-based friction modifiers, the metal-based detergent, the ash-free dispersant, and the phosphorus content in the lubricating oil composition etc. interact and solve the problems in the case of using a combination of plural types of molybdenum-based friction modifiers.

In the following description, "base oil (A)", "molybdenum-based friction modifier (B)", "metal-based detergent (C)", and "ash free dispersant (D)" are respectively also referred to as "component (A)", "component (B)", "component (C)", and "component (D)".

In the lubricating oil composition of the present embodiment, the total content of the components (A) to (D) based on the total amount of the lubricating oil composition is preferably 70% by mass or more, more preferably 75% by mass or more, and still more preferably 80% by mass or more.

In the lubricating oil composition of the present embodiment, the upper limit of the total content of the components (A) to (D) may be adjusted in relation to lubricating oil additives other than the components (A) to (D), and is usually less than 100% by mass, preferably 99% by mass or less, more preferably 98% by mass or less.

The upper and lower limits of these numerical ranges can be combined arbitrarily. Specifically, it is preferably 70% by mass or more and less than 100% by mass, more preferably 75% by mass or more and 99% by mass or less, and even more preferably 80% by mass or more and 98% by mass or less.

Each component contained in the lubricating oil composition of the present embodiment will be described in detail below.

<Base Oil (A)>

The lubricating oil composition of the present embodiment contains a base oil (A). As the base oil (A), one or more selected from mineral oils and synthetic oils conventionally used as lubricant base oils can be used without particular limitation.

Examples of the mineral oils include an atmospheric residual oil obtained by distilling a crude oil, such as a paraffinic crude oil, an intermediate base crude oil, and a naphthenic crude oil, under an atmospheric pressure; a distilled oil obtained by distilling the atmospheric residual oil under reduced pressure; and a mineral oil obtained by subjecting the distilled oil to one or more refining treatments such as solvent deasphalting, solvent extraction, hydrofinishing, hydrocracking, advanced hydrocracking, solvent dewaxing, catalytic dewaxing, and hydroisomerization dewaxing.

Examples of the synthetic oil include poly-α-olefins such as α-olefin homopolymers and α-olefin copolymers (for example, α-olefin copolymers having 8 to 14 carbon atoms such as ethylene-α-olefin copolymers); isoparaffins; various esters such as polyol esters and dibasic acid esters; various ethers such as polyphenyl ethers; polyalkylene glycols; alkylbenzene; alkylnaphthalenes; and GTL base oils or the like obtained by isomerizing wax produced from natural gas by the Fischer-Tropsch process or the like (GTL wax (gas-to-liquid wax)).

The base oil (A) used in the present embodiment is preferably a mineral oil categorized as Group II or III of API (American Petroleum Institute) base oil category.

As for the base oil (A), one kind selected from the mineral oils may be used alone, or two or more kinds selected from the mineral oils may be used in combination. In addition, one kind selected from the synthetic oils may be used alone, or two or more kinds selected from the synthetic oils may be used in combination. Furthermore, one or more mineral oils and one or more synthetic oils may be used in combination.

The upper limit, from the viewpoint of improving fuel saving properties, and the lower limit, from the viewpoint of reducing loss of the lubricating oil composition due to evaporation and ensuring oil film retention, of the kinematic viscosity and viscosity index of the base oil (A) are preferably in the following ranges.

The kinematic viscosity at 100° C. of the base oil (A) is preferably from 2.0 $mm^2/s$ to 6.0 $mm^2/s$, more preferably from 2.5 $mm^2/s$ to 5.5 $mm^2/s$, and further preferably from 3.0 $mm^2/s$ to 5.0 $mm^2/s$.

The viscosity index of the base oil (A) is preferably 80 or more, more preferably 90 or more, and further more preferably 100 or more.

As used herein, the kinematic viscosity at 100° C. and the viscosity index are values that are measured or calculated according to JIS K2283:2000.

In the case where the base oil (A) is a mixed base oil of two or more kinds of base oils, the mixed base oil preferably has a kinematic viscosity and a viscosity index within the aforementioned ranges.

In the lubricating oil composition of the present embodiment, the content of the base oil (A) is not particularly limited; however, from the viewpoint of facilitating the exhibition of the effects of the present invention, the content of the base oil (A) based on the total amount of the lubricating oil composition is preferably 60% by mass or more, more preferably 70% by mass or more, even more preferably 80% by mass or more, and is preferably 97% by mass or less, more preferably 96% by mass or less, even more preferably 95% by mass or less. The upper and lower limits of these numerical ranges can be combined arbitrarily. Specifically, the content of the base oil (A) based on the total amount of the lubricating oil composition is preferably 60% by mass or more and less than 97% by mass, more preferably 70% by mass or more and 96% by mass or less, and still more preferably 80% by mass or more and 95% by mass or less.

<Molybdenum-Based Friction Modifier (B)>

The lubricating oil composition of the present embodiment contains a molybdenum-based friction modifier (B).

The molybdenum-based friction modifier (B) contains two or more selected from the group consisting of a binuclear molybdenum dithiocarbamate (B1), a trinuclear molybdenum dithiocarbamate (B2), and a molybdenum-amine complex (B3).

By using a combination of plural types of molybdenum-based friction modifiers, a friction reducing effect is improved. Experiments by the present inventors have shown that the friction reducing effect is exhibited not only in a high-temperature environment but also in a low-temperature environment of about 30° C.

The molybdenum-based friction modifier (B) may contain molybdenum-based friction modifiers other than the binuclear molybdenum dithiocarbamate (B1), the trinuclear molybdenum dithiocarbamate (B2), and the molybdenum-amine complex (B3). Examples of the other molybdenum-based friction modifiers include a molybdenum dithiophosphate (MoDTP).

Here, from the viewpoint of facilitating the exhibition of the effects of the present invention, the total content of two or more selected from the group consisting of the binuclear molybdenum dithiocarbamate (B1), the trinuclear molybdenum dithiocarbamate (B2), and the molybdenum-amine complex (B3) in the molybdenum-based friction modifier (B) based on the total amount of the molybdenum-based friction modifier (B) is preferably 50% by mass to 100% by mass, more preferably 60% by mass to 100% by mass, further more preferably 70% to 100% by mass, even more preferably 80% to 100% by mass, still more preferably 90% to 100% by mass.

The binuclear molybdenum dithiocarbamate (B1), the trinuclear molybdenum dithiocarbamate (B2), and the molybdenum-amine complex (B3) are described in detail below.

(Binuclear Molybdenum Dithiocarbamate (B1))

Examples of the binuclear molybdenum dithiocarbamate include a compound represented by the following general formula (b1-1) and a compound represented by the following general formula (b1-2).

(b1-1)

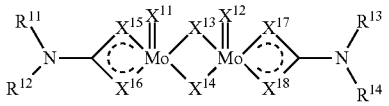

(b1-2)

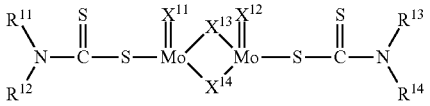

In the general formulas (b1-1) and (b1-2) above, $R^{11}$ to $R^{14}$ each independently represent a hydrocarbon group, and may be the same as or different from each other.

$X^{11}$ to $X^{18}$ each independently represent an oxygen atom or a sulfur atom, and may be the same as or different from each other, provided that at least two of $X^{11}$ to $X^{18}$ in the above general formula (b1-1) are sulfur atoms.

The hydrocarbon group that can be selected as $R^{11}$ to $R^{14}$ preferably has 6 to 22 carbon atoms.

Examples of the hydrocarbon group that can be selected as $R^{11}$ to $R^{14}$ in the above general formulas (b1-1) and (b1-2) include an alkyl group, an alkenyl group, a cycloalkyl group, an aryl group, an alkylaryl group, and an arylalkyl group.

Examples of the alkyl group include a hexyl group, a heptyl group, an octyl group, a nonyl group, a decyl group, an undecyl group, a dodecyl group, a tridecyl group, a tetradecyl group, a pentadecyl group, a hexadecyl group, a heptadecyl group, and an octadecyl group.

Examples of the alkenyl group include a hexenyl group, a heptenyl group, an octenyl group, a nonenyl group, a decenyl group, an undecenyl group, a dodecenyl group, a tridecenyl group, a tetradecenyl group, and a pentadecenyl group.

Examples of the cycloalkyl group include a cyclohexyl group, a dimethylcyclohexyl group, an ethylcyclohexyl group, a methylcyclohexylmethyl group, a cyclohexylethyl group, a propylcyclohexyl group, a butylcyclohexyl group, and a heptylcyclohexyl group.

Examples of the aryl group include a phenyl group, a naphthyl group, an anthracenyl group, a biphenyl group, and a terphenyl group.

Examples of the alkylaryl group include a tolyl group, a dimethylphenyl group, a butylphenyl group, a nonylphenyl group, and a dimethylnaphthyl group.

Examples of the arylalkyl group include a methylbenzyl group, a phenylmethyl group, a phenylethyl group, and a diphenylmethyl group.

Among these, molybdenum dialkyldithiocarbamate (B1a) represented by the following general formula (b1-3) (hereinafter also referred to as "compound (B1a)") is preferable.

(b1-3)

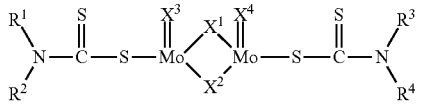

In the general formula (b1-3), $R^1$, $R^2$, $R^3$, and $R^4$ each independently represent a group of short-chain substituent groups (α) which are aliphatic hydrocarbon groups having 4 to 12 carbon atoms or a group of long-chain substituent groups (β) which are aliphatic hydrocarbon groups having 13 to 22 carbon atoms, provided that the molar ratio between the group of short-chain substituent groups (α) and the group of long-chain substituent groups (β) in the total molecule of the compound (B1a), [(α)/(β)] is 0.10 to 2.0. Further, in the general formula (b1-3), $X^1$, $X^2$, $X^3$ and $X^4$ each independently represent an oxygen atom or a sulfur atom.

Examples of the aliphatic hydrocarbon groups having 4 to 12 carbon atoms that can be selected as the group of short-chain substituent groups (α) include alkyl groups having 4 to 12 carbon atoms and alkenyl groups having 4 to 12 carbon atoms.

Specifically, examples thereof include butyl groups, pentyl groups, hexyl groups, heptyl groups, octyl groups, nonyl groups, decyl groups, undecyl groups, dodecyl groups, butenyl groups, pentenyl groups, hexenyl groups, heptenyl groups, octenyl groups, nonenyl groups, decenyl groups, undecenyl groups and dodecenyl groups. These may be linear or branched.

The number of carbon atoms in the aliphatic hydrocarbon groups that can be selected as the group of short-chain substituent groups (α) is preferably 5 to 11, more preferably 6 to 10, and even more preferably 7 to 9, from the viewpoint of facilitating the exhibition of the effects of the present invention.

Examples of aliphatic hydrocarbon groups having 13 to 22 carbon atoms that can be selected as the group of long-chain substituent groups (β) include alkyl groups having 13 to 22 carbon atoms and alkenyl groups having 13 to 22 carbon atoms.

Specifically, examples thereof include tridecyl groups, tetradecyl groups, pentadecyl groups, hexadecyl groups, heptadecyl groups, octadecyl groups, nonadecyl groups, icosyl groups, heneicosyl groups, docosyl groups, tridecenyl groups, tetradecenyl groups, pentadecenyl groups, hexadecenyl groups, heptadecenyl groups, octadecenyl groups, oleyl groups, nonadecenyl groups, icosenyl groups, henicosenyl groups and docosenyl groups. These may be linear or branched.

The number of carbon atoms in the aliphatic hydrocarbon groups that can be selected as the group of long-chain substituent groups (β) is preferably 13 to 20, more preferably 13 to 16, and even more preferably 13 to 14, from the viewpoint of facilitating the exhibition of the effects of the present invention.

Here, the molar ratio between the group of short-chain substituent groups (α) and the group of long-chain substituent groups (β) in the total molecule of the compound (B1a) represented by the general formula (b1-3), [(α)/(β)] is preferably 0.10 to 2.0. When the molar ratio [(α)/(β)] is 0.10 or more, the effect of the compound (B1a) on copper corrosion resistance is reduced, and the friction reducing effect is likely to be improved. Moreover, when the molar ratio [(α)/(β)] is 2.0 or less, it becomes easier to ensure low temperature storage stability. Here, from the viewpoint of reducing the influence on copper corrosion resistance and facilitating the improvement of the friction reducing effect, the molar ratio [(α)/(β)] is more preferably 0.15 or more, and further preferably 0.20 or more.

In addition, from the viewpoint of more easily ensuring low-temperature storage stability, the molar ratio [(α)/(β)] is more preferably 1.2 or less, further more preferably 1.0 or less, still more preferably 0.80 or less, even more preferably 0.60 or less, and still even more preferably 0.50 or less.

The upper and lower limits of these numerical ranges can be combined arbitrarily. Specifically, the molar ratio [(α)/(β)] is preferably 0.15 to 1.2, more preferably 0.20 to 1.0, further more preferably 0.20 to 0.80, still more preferably 0.20 to 0.60, and still even more preferably 0.20 to 0.50.

Here, the group of short-chain substituent groups (α) and the group of long-chain substituent groups (β) may coexist in the same molecule or may not coexist in the same molecule. That is, an average of the molar ratio between the group of short-chain substituent groups (α) and the group of long-chain substituent groups (β) in the total molecule of the compound (B1a) represented by the general formula (b1-3), [(α)/(β)] should be in the range of 0.10 to 1.2.

Therefore, in the compound (B1a), a molecular group (B1a-1) in which all of $R^1$, $R^2$, $R^3$, and $R^4$ in the general formula (b1-3) are the group of short-chain substituent groups (α) may be present, a molecular group (B1a-2) in which $R^1$, $R^2$, $R^3$, and $R^4$ are all the group of long-chain substituent groups (β) may be present, and a molecular group (B1a-3) in which part of $R^1$, $R^2$, $R^3$, and $R^4$ are the group of short-chain substituent groups (α) and the rest are the group of long-chain substituent groups (β) may also be present.

(Trinuclear Molybdenum Dithiocarbamate (B2))

Examples of the trinuclear molybdenum dithiocarbamate include a compound represented by the following general formula (b2).

$$Mo_3S_kE_mL_nA_pQ_z \quad \text{(b2)}$$

In the general formula (b2), k is an integer of 1 or more, m is an integer of 0 or more, and k+m is an integer of 4 to 10, preferably an integer of 4 to 7. n is an integer of 1 to 4, and p is an integer of 0 or more. z is an integer of 0 to 5, including non-stoichiometric values.

Each E is independently an oxygen atom or a selenium atom, and can, for example, substitute sulfur in a core described later.

Each L is independently an anionic ligand having an organic group containing a carbon atom, the total number of carbon atoms of the organic group in each ligand is 14 or more, and the ligands may be the same as or different from each other.

Each A is independently an anion other than L.

Each Q is independently an electron-donating neutral compound and is present to fill a vacant coordination on the trinuclear molybdenum compound.

The total number of carbon atoms of the organic group in the anionic ligand represented by L is preferably 14 to 50, more preferably 16 to 30, still more preferably 18 to 24.

L is preferably a monoanionic ligand that is a monovalent anionic ligand, and specifically, L is more preferably a ligand represented by the following general formulas (i) to (iv).

In the general formula (b2), the anionic ligand selected as L is preferably a ligand represented by the following general formula (iv).

Further, in the general formula (b2), it is preferable that all the anionic ligands selected as L are the same, and it is more preferable that all the anionic ligands selected as L are ligands represented by the following general formula (iv).

(i)

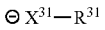

(ii)

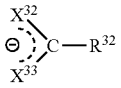

(iii)

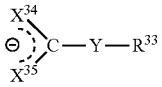

(iv)

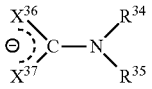

In the general formulas (i) to (iv), $X^{31}$ to $X^{37}$ and Y each are independently an oxygen atom or a sulfur atom, and may be the same as or different from each other.

In the general formulas (i) to (iv), $R^{31}$ to $R^{35}$ each are independently an organic group and may be the same as or different from each other.

The number of carbon atoms in each organic group that can be selected as $R^{31}$, $R^{32}$, and $R^{33}$, respectively, is preferably 14 to 50, more preferably 16 to 30, still more preferably 18 to 24.

The total number of carbon atoms of two organic groups that can be selected as $R^{34}$ and $R^{35}$ in the formula (iv) is preferably 14 to 50, more preferably 16 to 30, still more preferably 18 to 24. The number of carbon atoms in each organic group that can be selected as $R^{34}$ and $R^{35}$ is preferably 7 to 30, more preferably 7 to 20, still more preferably 8 to 13.

The organic group of $R^{34}$ and the organic group of $R^{35}$ may be the same as or different from each other; however, they are preferably different from each other. The number of carbon atoms in the organic group of $R^{34}$ and the number of carbon atoms in the organic group of $R^{35}$ may be the same as or different from each other; however, they are preferably different from each other.

Examples of the organic groups selected as $R^{31}$ to $R^{35}$ include hydrocarbyl groups such as alkyl groups, aryl groups, substituted aryl groups and ether groups.

The term "hydrocarbyl" refers to a substituent having a carbon atom directly attached to the remainder of a ligand and within the scope of the present embodiment is predominantly hydrocarbyl in character. Such substituents include the following.

1. Hydrocarbon Substituent

Examples of the hydrocarbon substituent include an aliphatic substituent such as alkyl and alkenyl, an alicyclic substituent such as cycloalkyl and cycloalkenyl, aromatic nuclei substituted with an aromatic group, an aliphatic group, and an alicyclic group, a cyclic group in which a ring is completed through another point in the ligand (that is, any two indicated substituents may together form an alicyclic group).

2. Substituted Hydrocarbon Substituent

Examples of the substituted hydrocarbon substituent include one in which the above hydrocarbon substituent is substituted with a non-hydrocarbon group that does not change the properties of the hydrocarbyl. Examples of the non-hydrocarbon group include a halogen group such as chloro and fluoro, an amino group, an alkoxy group, a mercapto group, an alkylmercapto group, a nitro group, a nitroso group, and a sulfoxy group.

In the general formula (b2), the anionic ligand selected as L is preferably derived from an alkylxanthate, a carboxylate, a dialkyldithiocarbamate, or a mixture thereof, and is more preferably derived from a dialkyldithiocarbamate.

In the general formula (b2), the anion that can be selected as A may be a monovalent anion or a divalent anion. Examples of anions that may be selected as A include disulfides, hydroxides, alkoxides, amides and thiocyanates, or derivatives thereof.

In the general formula (b2), examples of Q include water, amine, alcohol, ether, and phosphine. Q's may be the same or different, but are preferably the same.

The trinuclear molybdenum dithiocarbamate is preferably a compound in which, in the general formula (b2), k is an integer of 4 to 7, n is 1 or 2, L is a monoanionic ligand, and p is an integer that imparts electroneutrality to a compound based on an anionic charge in A, and each of m and z is 0, and more preferably a compound in which k is an integer of 4 to 7, L is a monoanionic ligand, n is 4, and each of p, m and z is 0.

Moreover, the trinuclear molybdenum dithiocarbamate is preferably a compound having a core represented by the following formula (IV-A) or (IV-B), for example. Each core has a net electrical charge of +4. These cores are surrounded by anionic ligands and, optionally, anions other than the anionic ligands.

(IV-A)

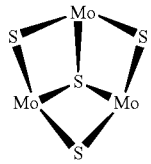

(IV-B)

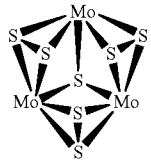

Formation of a trinuclear molybdenum sulfur compound requires the selection of appropriate anionic ligands (L) and other anions (A) depending, for example, on the number of sulfur and E atoms present in the cores. That is, the total anionic charge made up of the sulfur atom, the E atom if present, L, and A if present must be −4.

The trinuclear molybdenum sulfur compound may also contain cations other than molybdenum, such as (alkyl) ammonium, amine and sodium, when the anionic charge is greater than −4. A preferred embodiment of the anionic ligands (L) and other anions (A) is a configuration with four monoanionic ligands.

A molybdenum sulfur core, such as structures represented by the above (IV-A) and (IV-B), may be interconnected by one or more polydentate ligands, i.e., ligands with more than one functional groups capable of bonding to molybdenum atoms to form oligomers.

The molybdenum content in the trinuclear molybdenum dithiocarbamate (B2) based on the total amount of the trinuclear molybdenum dithiocarbamate (B2) is preferably 2.0% by mass or more, more preferably 4.0% by mass or more, even more preferably 5.0% by mass or more, and is preferably 9.0% by mass or less, more preferably 7.0% by mass or less, even more preferably 6.0% by mass or less.

The upper and lower limits of these numerical ranges can be combined arbitrarily. Specifically, the molybdenum content in the trinuclear molybdenum dithiocarbamate (B2) based on the total amount of the trinuclear molybdenum dithiocarbamate (B2) is preferably 2.0% by mass or more and 9.0% by mass or less, more preferably 4.0% by mass or more and 7.0% by mass or less, and still more preferably 5.0% by mass or more and 6.0% by mass or less.

(Molybdenum-Amine Complex (B3))

Examples of the molybdenum-amine complex (B3) include a molybdenum-amine complex obtained by reacting molybdenum trioxide and/or molybdic acid, which are hexavalent molybdenum compounds, with an amine compound.

Examples of the amine compound preferably include an alkylamine and a dialkylamine.

The alkylamine and dialkylamine to be reacted with the hexavalent molybdenum compound are not particularly limited, and examples thereof include alkylamines and dialkylamines having an alkyl group with 1 to 30 carbon atoms.

The molybdenum content in the molybdenum-amine complex (B3) based on the total amount of the molybdenum-amine complex (B3) is preferably 4.0% by mass or more, more preferably 6.0% by mass or more, and still more preferably 7.0% by mass or more, and is preferably 12.0% by mass or less, more preferably 10.0% by mass or less, and even more preferably 9.0% by mass or less.

The upper and lower limits of these numerical ranges can be combined arbitrarily. Specifically, the molybdenum content in the molybdenum-amine complex (B3) based on the total amount of the molybdenum-amine complex (B3) is preferably 4.0% by mass or more and 12.0% by mass or less, more preferably 6.0% by mass or more and 10.0% by mass or less, and still more preferably 7.0% by mass or more and 9.0% by mass or less.

(Content of Molybdenum-Based Friction Modifier (B))

In the lubricating oil composition of the present embodiment, the content of the molybdenum-based friction modifier (B) based on the total amount of the lubricating oil composition is, from the viewpoint of improving the friction reducing effect, preferably 0.30% by mass or more, more preferably 0.50% by mass or more, still more preferably 0.70% by mass or more, and is preferably 3.0% by mass or less, more preferably 2.0% by mass or less, and still more preferably 1.0% by mass or less.

The upper and lower limits of these numerical ranges can be combined arbitrarily. Specifically, the content of the molybdenum-based friction modifier (B) based on the total amount of the lubricating oil composition is preferably 0.30% by mass or more and 3.0% by mass or less, more preferably 0.50% by mass or more and 2.0% by mass or less, and still more preferably 0.70% by mass or more and 1.0% by mass or less.

In the lubricating oil composition of the present embodiment, the molybdenum content derived from the molybdenum-based friction modifier (B) based on the total amount of the lubricating oil composition is, from the viewpoint of improving the friction reducing effect, preferably 0.05% by mass or more, more preferably 0.06% by mass or more, and still more preferably 0.07% by mass or more.

In addition, the content of molybdenum atoms derived from the molybdenum-based friction modifier (B) based on the total amount of the lubricating oil composition is, from the viewpoint of reducing a sulfated ash content, preferably 0.12% by mass or less, more preferably 0.11% by mass or less, and even more preferably 0.10% by mass or less.

The upper and lower limits of these numerical ranges can be combined arbitrarily. Specifically, the content of molybdenum atoms derived from the molybdenum-based friction modifier (B) based on the total amount of the lubricating oil composition is preferably 0.05% by mass or more and 0.12% by mass or less, more preferably 0.06% by mass or more and 0.11% by mass or less, and still more preferably 0.07% by mass or more and 0.10% by mass or less.

(Content Ratio of Binuclear Molybdenum Dithiocarbamate (B1) and Trinuclear Molybdenum Dithiocarbamate (B2))

In the present embodiment, the content ratio of the binuclear molybdenum dithiocarbamate (B1) to the trinuclear molybdenum dithiocarbamate (B2), [(B1)/(B2)] is, from the viewpoint of improving the friction reducing action, preferably 0.1 to 10, more preferably 0.5 to 7.0, still more preferably 1.0 to 5.0, in terms of mass ratio.

(Content Ratio of Binuclear Molybdenum Dithiocarbamate (B1) and Molybdenum Amine Complex (B3))

In the present embodiment, the content ratio of the binuclear molybdenum dithiocarbamate to the molybdenum-amine complex, [(B1)/(B3)] is, from the viewpoint of improving the friction reducing effect, preferably 0.1 to 10, more preferably 1.0 to 8.0, and still more preferably 2.0 to 6.0, in terms of mass ratio.

(Acid Value Derived From Binuclear Molybdenum Dithiocarbamate (B1) and Trinuclear Molybdenum Dithiocarbamate (B2))

The lubricating oil composition of the present embodiment is required to have an acid value of less than 0.04 mgKOH/g derived from the binuclear molybdenum dithiocarbamate (B1) and the trinuclear molybdenum dithiocarbamate (B2).

When the acid value is 0.04 mgKOH/g or more, the high-temperature detergency, oxidation stability, and copper corrosion resistance of the lubricating oil composition may deteriorate.

Here, the acid value is preferably 0.03 mgKOH/g or less from the viewpoint of facilitating the improvement of all of the oxidation stability, high-temperature detergency, and copper corrosion resistance of the lubricating oil composition.

In the present description, the acid value derived from the binuclear molybdenum dithiocarbamate (B1) and the trinuclear molybdenum dithiocarbamate (B2) is a value measured according to JIS K2501:2003 (potentiometric titration method).

(Preferred Embodiment of Molybdenum-based Friction Modifier (B))

The molybdenum-based friction modifier (B) contains two or more selected from the group consisting of the binuclear molybdenum dithiocarbamate (B1), the trinuclear molybdenum dithiocarbamate (B2), and the molybdenum-amine complex (B3).

Therefore, the combination of the molybdenum-based friction modifier (B) includes any of the following aspects (1) to (4).

(1) Combination of the binuclear molybdenum dithiocarbamate (B1) and the trinuclear molybdenum dithiocarbamate (B2)

(2) Combination of the binuclear molybdenum dithiocarbamate (B1) and the molybdenum-amine complex (B3)

(3) Combination of the trinuclear molybdenum dithiocarbamate (B2) and the molybdenum-amine complex (B3)

(4) Combination of the binuclear molybdenum dithiocarbamate (B1), the trinuclear molybdenum dithiocarbamate (B2), and the molybdenum-amine complex (B3)

Among these combinations, the combination (1), (2), or (4) containing the binuclear molybdenum dithiocarbamate (B1) is preferable from the viewpoint of facilitating the exhibition of the effects of the present invention.

<Metal-Based Detergent (C)>

The lubricating oil composition of the present embodiment contains a metal-based detergent (C). Moreover, in the present embodiment, the metal-based detergent (C) contains a sulfur atom.

When the lubricating oil composition does not contain the metal-based detergent (C), high-temperature detergency cannot be sufficiently ensured.

Examples of the metal-based detergent (C) include an organic acid metal salt compound containing a sulfur atom and a metal atom selected from an alkali metal and an alkaline earth metal.

In the present description, the "alkali metal" refers to lithium, sodium, potassium, rubidium, and cesium.

Further, in the present description, the "alkaline earth metal" refers to beryllium, magnesium, calcium, strontium, and barium.

From the viewpoint of improving high-temperature detergency, the metal atom contained in the metal-based detergent (C) is preferably sodium, calcium, magnesium, or barium, and more preferably calcium or magnesium.

That is, the metal-based detergent (C) preferably contains one or more selected from the group consisting of a sodium-based detergent, a calcium-based detergent, a magnesium-based detergent, and a barium-based detergent, and more preferably contains one or more selected from the group consisting of a calcium-based detergent and a magnesium-based detergent.

Here, examples of the metal-based detergent (C) containing a sulfur atom include a metal sulfonate and a metal phenate, and the metal sulfonate is preferable.

A compound represented by the following general formula (c-1) is preferable as the metal sulfonate. In addition, a compound represented by the following general formula (c-2) is preferable as the metal phenate.

(c-1)

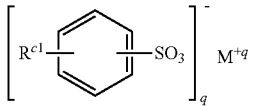

(c-2)

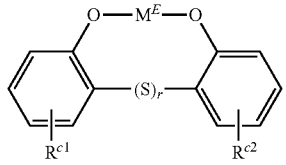

In the above general formulas (c-1) to (c-2), M is a metal atom selected from an alkali metal and an alkaline earth metal, and is preferably sodium, calcium, magnesium, or barium, more preferably calcium or magnesium.

$M^E$ is an alkaline earth metal, preferably calcium, magnesium or barium, more preferably calcium or magnesium.

q is the valence of M and is 1 or 2. $R^{c1}$ and $R^{c2}$ each are independently a hydrogen atom or a hydrocarbon group having 1 to 18 carbon atoms.

S represents a sulfur atom.

r is an integer of 1 or more, preferably an integer of 1 to 3.

Examples of hydrocarbon groups that can be selected as $R^{c1}$ and $R^{c2}$ include alkyl groups having 1 to 18 carbon atoms, alkenyl groups having 1 to 18 carbon atoms, cycloalkyl groups having 3 to 18 ring carbon atoms, aryl groups having 6 to 18 ring carbon atoms, alkylaryl groups having 7 to 18 carbon atoms, and arylalkyl groups having 7 to 18 carbon atoms.

One of these may be used alone or two or more kinds thereof may be used in combination.

Among these, one or more selected from the group consisting of calcium sulfonate, calcium phenate, magnesium sulfonate, and magnesium phenate are preferable, and one or more selected from the group consisting of calcium sulfonate and magnesium sulfonate are more preferable, from the viewpoint of further easily improving high temperature detergency and the viewpoint of solubility in the base oil (A).

In the following description, a calcium-based detergent containing a sulfur atom is also referred to as a "calcium-based detergent (C1)", and a magnesium-based detergent containing a sulfur atom is also referred to as a "magnesium-based detergent (C2)".

The metal-based detergent (C) may be any of a neutral salt, a basic salt, an overbased salt, and a mixture thereof. However, from the viewpoint of facilitating adjustment of an initial base number to a predetermined value or greater, and from the viewpoint of facilitating the improvement of the base number retention property, a basic salt or an overbased salt is preferable, and an overbased salt is more preferable.

In the present description, a metal-based detergent having a base number of less than 50 mgKOH/g is defined as "neutral", a metal-based detergent having a base number of 50 mgKOH/g or more and less than 150 mgKOH/g is defined as "basic", and a metal-based detergent having a base number of 150 mg KOH/g or more is defined as "overbased".

When an overbased detergent is used as the metal-based detergent (C), the base number of the metal-based detergent (C) is preferably 200 mgKOH/g or more and 500 mgKOH/g or less, more preferably 250 mgKOH/g or more and 450 mgKOH/g or less.

In the present description, the base number of the metal-based detergent (B) means a value measured by a potentiometric titration method (base number/perchloric acid method) according to JIS K2501:2003-9.

In the present embodiment, when the metal-based detergent (C) contains the calcium-based detergent (C1), the base number of the calcium-based detergent (C1) is preferably 200 mgKOH/g or more and 500 mgKOH/g or less, more preferably 250 mgKOH/g or more and 450 mgKOH/g or less, and even more preferably 250 mgKOH/g or more and 400 mgKOH/g or less.

When the metal-based detergent (C) contains the calcium-based detergent (C1), the calcium-based detergent (C1) is preferably one or more selected from the group consisting of calcium sulfonate and calcium phenate, and is more preferably calcium sulfonate.

In the present embodiment, when the metal-based detergent (C) contains the magnesium-based detergent (C2), the base number of the magnesium-based detergent is preferably 200 mgKOH/g or more and 500 mgKOH/g or less, more preferably 250 mgKOH/g or more and 500 mgKOH/g or less, and even more preferably 300 mgKOH/g or more and 450 mgKOH/g or less.

When the metal-based detergent (C) contains the magnesium-based detergent (C2), the magnesium-based detergent (C2) is preferably one or more selected from the group consisting of magnesium sulfonate and magnesium phenate, and is more preferably magnesium sulfonate.

In the lubricating oil composition of the present embodiment, the content of the metal-based detergent (C) based on the total amount of the lubricating oil composition is, from the viewpoint of facilitating the exhibition of the effects of the present invention, preferably 0.1% by mass or more, more preferably 0.5% by mass or more, and still more preferably 0.8% by mass or more, and is preferably 5.0% by mass or less, more preferably 4.0% by mass or less, and still more preferably 3.0% by mass or less.

The upper and lower limits of these numerical ranges can be combined arbitrarily. Specifically, the content of the metal-based detergent (C) based on the total amount of the lubricating oil composition is preferably 0.1% by mass or more and 5.0% by mass or less, more preferably 0.5% by mass or more and 4.0% by mass or less, and still more preferably 0.8% by mass or more and 3.0% by mass or less.

One of the metal-based detergents (C) may be used alone or two or more kinds thereof may be used in combination. When two or more kinds thereof are used, a suitable total content is the same as the above content.

In the lubricating oil composition of the present embodiment, when the metal-based detergent (C) contains the calcium-based detergent (C1), the calcium content derived from the calcium-based detergent (C1) is, from the viewpoint of facilitating the improvement of high-temperature detergency, preferably 0.10% by mass or more, more preferably 0.11% by mass or more, based on the total amount of the lubricating oil composition.

In addition, the calcium content derived from the calcium-based detergent (C1) based on the total amount of the lubricating oil composition is, from the viewpoint of decreasing a sulfated ash content and from the viewpoint of preventing LSPI (abnormal combustion), preferably 0.20% by mass or less, more preferably 0.15% by mass or less, still more preferably 0.13% by mass or less.

The upper and lower limits of these numerical ranges can be combined arbitrarily. Specifically, the calcium content derived from the calcium-based detergent (C1) based on the total amount of the lubricating oil composition is preferably 0.10% by mass or more and 0.20% by mass or less, more preferably 0.10% by mass or more and 0.15% by mass or less, and still more preferably 0.11% by mass or more and 0.13% by mass or less.

In the lubricating oil composition of the present embodiment, when the metal-based detergent (C) contains the magnesium-based detergent (C2), the magnesium content derived from the magnesium-based detergent (C2) is, from the viewpoint of facilitating the improvement of high-temperature detergency, preferably 0.03% by mass or more, more preferably 0.04% by mass or more, and still more preferably 0.05% by mass or more, based on the total amount of the lubricating oil composition.

In addition, the magnesium content derived from the magnesium-based detergent (C2) based on the total amount of the lubricating oil composition is, from the viewpoint of decreasing the sulfated ash content and from the viewpoint of preventing LSPI (abnormal combustion), preferably 0.08% by mass or less, more preferably 0.07% by mass or less, still more preferably 0.06% by mass or less.

The upper and lower limits of these numerical ranges can be combined arbitrarily. Specifically, the magnesium content derived from the magnesium-based detergent (C2) based on the total amount of the lubricating oil composition is preferably 0.03% by mass or more and 0.07% by mass or less, more preferably 0.04% by mass or more and 0.06% by mass or less.

In the metal-based detergent (C), the content of one or more metal-based detergents selected from the group consisting of the calcium-based detergent (C1) and the magnesium-based detergent (C2) based on the total amount of the metal-based detergent (C) is preferably 50% by mass or more and 100% by mass or less, more preferably 60% by mass or more and 100% by mass or less, still more preferably 70% by mass or more and 100% by mass or less, further more preferably 80% by mass or more and 100% by mass or less, and even more preferably 90% by mass or more and 100% by mass or less.

<Ash-Free Dispersant (D)>

The lubricating oil composition of the present embodiment contains an ash-free dispersant (D). Moreover, in the present embodiment, the ash-free dispersant (D) contains a nitrogen atom.

When the lubricating oil composition does not contain the ash-free dispersant (D), high-temperature detergency cannot be sufficiently ensured.

Examples of the ash-free dispersants (D) include one or more compounds selected from the group consisting of succinic monoimides such as alkenylsuccinic monoimides and alkylsuccinic monoimides; boron-modified succinic monoimides; succinic bisimides such as alkenylsuccinic bisimides and alkylsuccinic bisimides; and boron-modified succinic bisimides.

Among these, one or more selected from the group consisting of succinic monoimide (non-boron-modified) and succinic bisimide (non-boron-modified) is preferable, and succinic monoimide (non-boron-modified) is more preferable.

One of the ash-free dispersants (D) may be used alone or two or more kinds thereof may be used in combination.

Examples of the alkenylsuccinic monoimide or alkylsuccinic monoimide include a compound represented by the following general formula (d1). Further, examples of the alkenylsuccinic bisimide or alkylsuccinic bisimide include a compound represented by the following general formula (d2).

(d1)

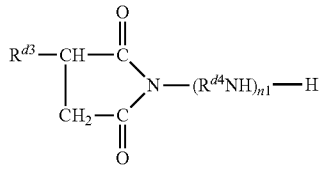

(d2)

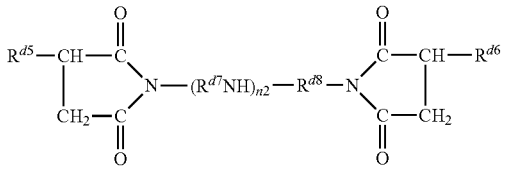

In the general formulas (d1) and (d2), $R^{d3}$, $R^{d5}$, and $R^{d6}$ are alkenyl groups or alkyl groups, and each have a mass average molecular weight (Mw) of preferably 500 to 3,000, more preferably 1,000 to 3,000.

When the mass average molecular weights of $R^{d3}$, $R^{d5}$ and $R^{d6}$ are 500 or more, the solubility in the base oil (A) can be improved. Further, when the mass average molecular weights of $R^{d3}$, $R^{d5}$, and $R^{d6}$ are 3,000 or less, the effects of the present invention can be exhibited more easily. $R^{d5}$ and $R^{d6}$ may be the same or different.

$R^{d4}$, $R^{d7}$, and $R^{d8}$ each are an alkylene group having 2 to 5 carbon atoms, and $R^{d7}$ and $R^{d8}$ may be the same or different.

n1 represents an integer of 1 to 10, and n2 represents 0 or an integer of 1 to 10.

Here, n1 is preferably 2 to 5, more preferably 2 to 4. When n1 is 2 or more, the effects of the present invention can be exhibited more easily. When n1 is 5 or less, the solubility in the base oil (A) is even better.

In addition, n2 is preferably 1 to 6, more preferably 2 to 6. When n2 is 1 or more, the effects of the present invention can be exhibited more easily. When n2 is 6 or less, the solubility in the base oil (A) is even better.

Examples of the alkenyl group that can be selected as $R^{d3}$, $R^{d5}$, and $R^{d6}$ include a polybutenyl group, a polyisobutenyl group, and an ethylene-propylene copolymer, preferably a polybutenyl group or a polyisobutenyl group. As the polybutenyl group, a mixture of 1-butene and isobutene or a polymer obtained by polymerizing high-purity isobutene is preferably used.

Examples of the alkyl group that can be selected as $R^{d3}$, $R^{d5}$, and $R^{d6}$ include a hydrogenated polybutenyl group, a hydrogenated polyisobutenyl group, and a hydrogenated ethylene-propylene copolymer, preferably a hydrogenated polybutenyl group or a hydrogenated polyisobutenyl group.

The above alkenyl succinimide or alkyl succinimide can be produced generally by reacting an alkenylsuccinic anhydride obtained through reaction of a polyolefin and maleic anhydride, or an alkylsuccinic anhydride obtained through hydrogenation of the alkenylsuccinic anhydride, with a polyamine. The monoimide or bisimide can be produced by varying the ratio of the alkenylsuccinic anhydride or alkylsuccinic anhydride and the polyamine.

The above alkenyl succinimide or alkyl succinimide succinimide may be a boron-modified form. The boron-modified form can be produced, for example, by reacting a boron-free alkenylsuccinic monoimide or alkylsuccinic monoimide, or an alkenylsuccinic bisimide or an alkylsuccinic bisimide, with a boron compound. The boron-modified form is preferably a boron-modified alkenylsuccinic bisimide or a boron-modified alkylsuccinic bisimide.

As an olefin monomer forming the polyolefin, for example, one or more selected from α-olefins having 2 to 8 carbon atoms can be used, and a mixture of isobutene and 1-butene can be preferably used.

The polyamine includes simple diamines such as ethylenediamine, propylenediamine, butylenediamine, and pentylenediamine; polyalkylenepolyamines such as diethylenetriamine, triethylenetetramine, tetraethylenepentamine, pentaethylenehexamine, di(methylethylene)triamine, dibutylenetriamine, tributylenetetramine, and pentapentylenehexamine; and piperazine derivatives such as aminoethylpiperazine.

One of the polyamines may be used alone or two or more kinds thereof may be used in combination.

Examples of the boron compound include a boric acid, a borate, and a borate ester.

Examples of the boric acid include an orthoboric acid, a metaboric acid, and a paraboric acid.

Examples of the borates include ammonium borates such as ammonium metaborate, ammonium tetraborate, ammonium pentaborate and ammonium octaborate.

Examples of the borate ester include monomethyl borate, dimethyl borate, trimethyl borate, monoethyl borate, diethyl borate, triethyl borate, monopropyl borate, dipropyl borate, tripropyl borate, monobutyl borate, dibutyl borate, and tributyl borate.

In the lubricating oil composition of the present embodiment, the content of nitrogen atoms derived from the ash-free dispersant based on the total amount of the lubricating oil composition is, from the viewpoint of facilitating the exhibition of the effects of the present invention, preferably 0.01% by mass or more, more preferably 0.02% by mass or more, and still more preferably 0.03% by mass or more, and is preferably 0.10% by mass or less, more preferably 0.08% by mass or less, and still more preferably 0.07% by mass or less.

The upper and lower limits of these numerical ranges can be combined arbitrarily. Specifically, the content of nitrogen atoms derived from the ash-free dispersant based on the total amount of the lubricating oil composition is preferably 0.01% by mass or more and 0.10% by mass or less, more preferably 0.02% by mass or more and 0.08% by mass or less, and still more preferably 0.03% by mass or more and 0.07% by mass or less.

<Content Ratio of Sulfur Content ($C_S$) Derived From Metal-based Detergent (C) to Nitrogen Content ($D_N$) Derived from Ash-free Dispersant (D)>

In the lubricating oil composition of the present embodiment, the content ratio of the sulfur content ($C_S$) derived from the metal-based detergent (C) to the nitrogen content ($D_N$) derived from the ash-free dispersant (D), $[(C_S)/(D_N)]$ is required to be 0.30 to 0.85 in mass ratio.

When $[(C_S)/(D_N)]$ is less than 0.30, the lubricating oil composition is inferior in oxidation stability and high-temperature detergency. On the other hand, when $[(C_S)/(D_N)]$ is more than 0.85, the lubricating oil composition is inferior in copper corrosion resistance and high-temperature detergency.

Here, from the viewpoint of facilitating the improvement of all of oxidation stability, high-temperature detergency, and copper corrosion resistance, $[(C_S)/(D_N)]$ is preferably 0.32 or more, more preferably 0.34 or more, and still more preferably 0.35 or more, and is preferably 0.83 or less, more preferably 0.81 or less, and still more preferably 0.79 or less.

The upper and lower limits of these numerical ranges can be combined arbitrarily. Specifically, $[(C_S)/(D_N)]$ is preferably 0.32 to 0.83, more preferably 0.34 to 0.81, still more preferably 0.35 to 0.79.

<Metal Deactivator (E)>

The lubricating oil composition of the present embodiment preferably contains a metal deactivator (E) from the viewpoint of facilitating the improvement of copper corrosion resistance.

Examples of the metal deactivator (E) include a benzotriazole-based compound, a tolyltriazole-based compound, a thiadiazole-based compound, an imidazole-based compound, and a pyrimidine-based compound.

One of these may be used alone or two or more kinds thereof may be used in combination.

Among these, the lubricating oil composition of the present embodiment preferably contains a benzotriazole-based compound from the viewpoint of improving copper corrosion resistance.

As the benzotriazole-based compound, one or more selected from benzotriazole-based compounds conventionally used as metal deactivators can be used without particular limitation.

Here, in the present embodiment, from the viewpoint of improving copper corrosion resistance, the benzotriazole-based compound preferably contains a benzotriazole-based compound (E1) represented by the following general formula (e1).

(e1)

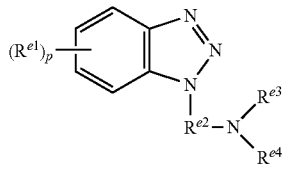

In the general formula (e1), $R^{e1}$ is an alkyl group having 1 to 4 carbon atoms. The alkyl group may be linear or branched. Here, from the viewpoint of improving copper corrosion resistance, the number of carbon atoms in the alkyl group is preferably 1 to 3, more preferably 1 to 2, and still more preferably 1.

In the general formula (e1), p is an integer of 0 to 4. When there are plurality of $R^{e1}$'s (that is, when p is an integer of 2 to 4), the plurality of $R^{e1}$'s may be the same as or different from each other. Here, p is preferably 0 to 3, more preferably 0 to 2, and still more preferably 1 from the viewpoint of improving copper corrosion resistance.

In the general formula (e1), $R^{e2}$ is a methylene group or an ethylene group. Here, from the viewpoint of improving copper corrosion resistance, $R^{e2}$ is preferably a methylene group.

In the general formula (e1), $R^{e3}$ and $R^{e4}$ are each independently a hydrogen atom or an alkyl group having 1 to 18 carbon atoms. The alkyl group may be linear or branched, preferably branched. The number of carbon atoms in the alkyl group is preferably 2 to 14, more preferably 4 to 12, still more preferably 6 to 10.

When the metal deactivator (E) contains the benzotriazole-based compound (E1), the content of the benzotriazole-based compound (E1) based on the total amount of the metal deactivator (E) is preferably 50% by mass or more and 100% by mass or less, more preferably 60% by mass or more and 100% by mass or less, still more preferably 70% by mass or more and 100% by mass or less, even more preferably 80% by mass or more and 100% by mass or less, and further more preferably 90% by mass or more and 100% by mass or less.

In the lubricating oil composition of the present embodiment, the content of the metal deactivator (E) based on the total amount of the lubricating oil composition is, from the viewpoint of further improving the friction reducing effect, preferably 0.03% by mass or less, more preferably 0.02% by mass or less, still more preferably 0.015% by mass or less.

In addition, the content of the benzotriazole-based compound is preferably 0.003% by mass or more, more preferably 0.005% by mass or more, from the viewpoint of facilitating the improvement of copper corrosion resistance.

The upper and lower limits of these numerical ranges can be combined arbitrarily. Specifically, it is preferably 0.003% by mass or more and 0.03% by mass or less, more preferably 0.005% by mass or more and 0.02% by mass or less, and still more preferably 0.005% by mass or more and 0.015% by mass or less.

<Other Components>

The lubricating oil composition of the present embodiment may contain other components than the components described above, if necessary, within a range that does not impair the effects of the present invention.

Examples of additives as other components include anti-wear agents, antioxidants, viscosity index improvers, pour point depressants, extreme pressure agents, rust inhibitors, anti-foaming agents, demulsifiers, friction modifiers other than the molybdenum-based friction modifier (B), and metal-based detergents (C') other than the metal-based detergent (C).

One of these may be used alone or two or more kinds thereof may be used in combination.

(Anti-Wear Agent)

Examples of the anti-wear agent include zinc-containing compounds such as zinc dialkyldithiophosphate (ZnDTP) and zinc phosphate; sulfur-containing compounds such as disulfides, sulfurized olefins, sulfurized fats and oils, sulfurized esters, thiocarbonates, thiocarbamates, and polysulfides; phosphorous-containing compounds such as phosphites, phosphates, phosphonates, and amine salts or metal salts thereof; sulfur- and phosphorus-containing anti-wear agents such as thiophosphites, thiophosphates, thiophosphonates, and amine salts or metal salts thereof.

One of these may be used alone or two or more kinds thereof may be used in combination.

Here, as the anti-wear agent, an anti-wear agent containing a phosphorus atom (hereinafter also referred to as "phosphorus anti-wear agent") is preferable. As the phosphorus-based anti-wear agent, zinc dialkyldithiophosphate (ZnDTP) is preferable.

Preferred examples of the zinc dialkyldithiophosphate (ZnDTP) include a compound represented by the following general formula (f-1).

(f-1)

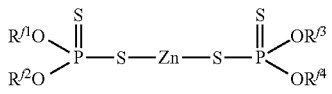

In the general formula (f-1), $R^{f1}$ to $R^{f4}$ each independently represent a hydrocarbon group. The hydrocarbon group is not particularly limited as long as it is a monovalent hydrocarbon group, and from the viewpoint of improving oxidation stability, preferred examples thereof include an alkyl group, an alkenyl group, a cycloalkyl group, and an aryl group, and an alkyl group is more preferred.

The alkyl groups and alkenyl groups of $R^{f1}$ to $R^{f4}$ may be linear or branched.

Further, from the viewpoint of further improving oxidation stability, when the monovalent hydrocarbon group is an alkyl group, the number of carbon atoms in the hydrocarbon groups of $R^{f1}$ to $R^{f4}$ is preferably 1 or more, more preferably 2 or more, and even more preferably 3 or more, and the upper limit is preferably 24 or less, more preferably 18 or less, and still more preferably 12 or less. When the monovalent hydrocarbon is an alkenyl group, the number of carbon atoms in the hydrocarbon groups of $R^{f1}$ to $R^{f4}$ is preferably 2 or more, more preferably 3 or more, and the upper limit is preferably 24 or less, more preferably 18 or less, and still more preferably 12 or less.

The cycloalkyl groups and aryl groups of $R^{f1}$ to $R^{f4}$ may be polycyclic groups such as decalyl groups and naphthyl groups. The number of carbon atoms in the hydrocarbon group of $R^{f1}$ to $R^{f4}$ is, when the monovalent hydrocarbon is a cycloalkyl group, preferably 5 or more, and the upper limit is preferably 20 or less. When the monovalent hydrocarbon is an aryl group, the number of carbon atoms is preferably 6 or more, and the upper limit is preferably 20 or less.

In addition, the monovalent hydrocarbon group may be partially substituted with a group containing an oxygen atom and/or a nitrogen atom such as a hydroxy group, a carboxy group, an amino group, an amide group, a nitro group, and a cyano group, and it may be partially substituted with a nitrogen atom, an oxygen atom, a halogen atom or the like. When the monovalent hydrocarbon group is a cycloalkyl group or an aryl group, it may further have a substituent such as an alkyl group or an alkenyl group.

When the lubricating oil composition of the present embodiment contains a phosphorus-based anti-wear agent, the phosphorus content derived from the phosphorus-based anti-wear agent based on the total amount of the lubricating oil composition is preferably more than 0.04% by mass and 0.10% by mass or less, more preferably 0.05% by mass or more and 0.09% by mass or less, still more preferably 0.06% by mass or more and 0.08% by mass or less.

(Antioxidant)

Examples of antioxidants include amine-based antioxidants and phenol-based antioxidants.

Examples of the amine-based antioxidant include a diphenylamine-based antioxidant such as diphenylamine and alkylated diphenylamine having an alkyl group having 3 to 20 carbon atoms; and a naphthylamine-based antioxidant such as phenyl-α-naphthylamine, phenyl-β-naphthylamine, substituted phenyl-α-naphthylamine having an alkyl group having 3 to 20 carbon atoms, and substituted phenyl-β-naphthylamine having an alkyl group of 3 to 20 carbon atoms.

Examples of the phenol-based antioxidant include a monophenol-based antioxidant such as 2,6-di-tert-butylphenol, 2,6-di-tert-butyl-4-methylphenol, 2,6-di-tert-butyl-4-ethylphenol, isooctyl-3-(3,5-di-tert-butyl-4-hydroxyphenyl) propionate, and octadecyl-3-(3,5-di-tert-butyl-4-hydroxyphenyl)propionate; a diphenol-based antioxidant such as 4,4'-methylenebis(2,6-di-tert-butylphenol) and 2,2'-methylenebis(4-ethyl-6-tert-butylphenol); and a hindered phenol-based antioxidant.

One of these may be used alone or two or more kinds thereof may be used in combination.

(Viscosity Index Improver)

Examples of the viscosity index improver include polymers such as a non-dispersion type poly(meth)acrylate, a dispersion type poly(meth)acrylate, a comb-shaped polymer, a star-shaped polymer, an olefin copolymer (such as an ethylene-propylene copolymer), a dispersion type olefin copolymer, and a styrene copolymer (such as a styrene-diene copolymer and a styrene-isoprene copolymer).

The mass average molecular weight (Mw) of the viscosity index improver is preferably 100,000 to 1,000,000, more preferably 200,000 to 800,000, and still more preferably 250,000 to 750,000.

The molecular weight distribution (Mw/Mn) of the viscosity index improver is preferably 5.00 or less, more preferably 4.00 or less, still more preferably 3.00 or less, and is usually 1.01 or more.

One of the viscosity index improvers may be used alone or two or more kinds thereof may be used in combination.

(Pour Point Depressant)

Examples of the pour point depressant include an ethylene-vinyl acetate copolymer, a condensate of chlorinated paraffin and naphthalene, a condensate of chlorinated paraffin and phenol, a polymethacrylate (PMA; polyalkyl (meth)acrylate etc.), a polyvinyl acetate, a polybutene, and a polyalkylstyrene, and a polymethacrylate is preferably used.

One of these may be used alone or two or more kinds thereof may be used in combination.

(Extreme Pressure Agent)

Examples of the extreme pressure agent include a sulfur-based extreme pressure agent such as a sulfide, a sulfoxide, a sulfone and a thiophosphinate, a halogen-based extreme pressure agent such as a chlorinated hydrocarbon, and an organic metal-based extreme pressure agent. Further, among the anti-wear agents described above, a compound having a function as an extreme pressure agent can also be used.

One of these may be used alone or two or more kinds thereof may be used in combination.

(Rust Inhibitor)

Examples of the rust inhibitor include a fatty acid, an alkenylsuccinic acid half ester, a fatty acid soap, an alkylsulfonate, a polyhydric alcohol fatty acid ester, a fatty acid amine, a paraffin oxide, and an alkyl polyoxyethylene ether.

One of these may be used alone or two or more kinds thereof may be used in combination.

(Anti-Foaming Agent)

Examples of the anti-foaming agent include a silicone oil such as dimethylpolysiloxane, a fluorosilicone oil, and a fluoroalkyl ether.

One of these may be used alone or two or more kinds thereof may be used in combination.

(Demulsifier)

Examples of the demulsifier include an anionic surfactant such as a castor oil sulfate and a petroleum sulfonate; a cationic surfactant such as a quaternary ammonium salt and an imidazoline; a polyalkylene glycol-based nonionic surfactant such as a polyoxyethylene alkyl ether, a polyoxyethylene alkylphenyl ether, and a polyoxyethylene alkylnaphthyl ether; polyoxyalkylene polyglycol and a dicarboxylic acid ester thereof; and an alkylene oxide adduct of alkylphenol-formaldehyde polycondensate.

One of these may be used alone or two or more kinds thereof may be used in combination.

(Friction Modifiers Other Than Molybdenum-Based Friction Modifiers (B))

The lubricating oil composition of the present embodiment may contain friction modifiers other than the molybdenum-based friction modifier (B).

Examples of the friction modifiers other than the molybdenum-based friction modifier (B) include ash-free friction modifiers such as aliphatic amines, fatty acid esters, fatty acid amides, fatty acids, aliphatic alcohols, and aliphatic ethers; fats and oils, amines, amides, sulfide esters, phosphate esters, phosphites, and phosphate amine salts.

One of these may be used alone or two or more kinds thereof may be used in combination.

(Metal-Based Detergent (C') Other Than Metal-based Detergent (C))

The lubricating oil composition of the present embodiment may contain a metal-based detergent (C') other than the metal-based detergent (C).

Examples of the metal-based detergent (C') include an organic acid metal salt compound containing a metal atom selected from an alkali metal and an alkaline earth metal and containing no sulfur atoms.

Examples of such compounds include metal salicylates.

One of the metal-based detergents (C') may be used alone or two or more kinds thereof may be used in combination.

(Content of Other Components)

The content of the above-mentioned other components can be appropriately adjusted within a range that does not impair the effects of the present invention; however, the content of each of the other components based on the total amount of the lubricating oil composition is generally 0.001% by mass or more and 15% by mass or less, preferably 0.005% by mass or more and 10% by mass or less.

In the present description, an additive as the other component may be blended with other components in a form of a solution diluted and dissolved in a part of the base oil (A) described above in consideration of handling property, solubility in the base oil (A), etc. In such a case, in the present description, the above-mentioned content of the additive as the other component means the content in terms of active ingredients (in terms of resin content) excluding diluent oil.

The lubricating oil composition of the present embodiment exerts a friction reducing effect even in a temperature range of 30° C. without blending an ash-free friction modifier.

Therefore, the lubricating oil composition of the present embodiment may contain a small amount of ash-free friction modifier. Specifically, the content of the ash-free friction modifier based on the total amount of the lubricating oil composition is preferably less than 0.1% by mass, more preferably less than 0.01% by mass, and still more preferably not containing the friction modifier.

[Physical Properties of Lubricating Oil Composition]

<Kinematic Viscosity, Viscosity Index>

The lubricating oil composition according to the present embodiment has a kinematic viscosity at 100° C. of preferably 12.5 $mm^2/s$ or less, more preferably 9.3 $mm^2/s$ or less, and still more preferably 9.0 mm2/s or less, from the viewpoint of improvement in fuel efficiency.

In addition, from the viewpoint of easily suppressing evaporation loss of the lubricating oil composition, the kinematic viscosity at 100° C. is preferably 5.0 $mm^2/s$ or more, more preferably 6.1 $mm^2/s$ or more, and still more preferably 6.9 $mm^2/s$ or more.

The lubricating oil composition according to the present embodiment has a viscosity index of preferably 150 or more, more preferably 200 or more, and even more preferably 220 or more.

<HTHS Viscosity at 150° C.>

From the viewpoint of oil film retention, the lubricating oil composition according to the present embodiment has an HTHS viscosity (high-temperature high-shear viscosity) at 150° C. of preferably 1.7 mPa·s or more, more preferably 2.0 mPa·s or more, and still more preferably 2.3 mPa·s or more. In addition, the HTHS viscosity at 150° C. of the lubricating oil composition according to the present embodiment is, from the viewpoint of improving fuel saving properties, preferably less than 2.9 mPa·s, more preferably 2.6 mPa·s or less.

In the present description, the HTHS viscosity at 150° C. of the lubricating oil composition is a value measured at a temperature of 150° C. and a shear rate of $10^6/s$ using a TBS high temperature viscometer (Tapered Bearing Simulator Viscometer) in accordance with ASTM D4683.

<CCS Viscosity at −35° C.>

The lubricating oil composition of the present embodiment preferably has a CCS viscosity at −35° C. of 6,200 mPa·s or less, more preferably 6,000 mPa·s or less, from the viewpoint of obtaining good low-temperature viscosity characteristics.

As used herein, the CCS viscosity at −35° C. of the lubricating oil composition is a value measured according to JIS K2010:1993.

<Content of Various Atoms>

The contents of various atoms in the lubricating oil composition of the present embodiment are as described below.

In the present description, the molybdenum content, boron content, calcium content, magnesium content, phosphorus content, and sulfur content of the lubricating oil composition are values measured according to JIS-5S-38-03.

In addition, the nitrogen content of the lubricating oil composition is a value measured by a chemiluminescence method in accordance with JIS K2609:1998.

(Sulfur Content)

The lubricating oil composition of the present embodiment preferably has a sulfur content of 0.35% by mass or less based on the total amount of the lubricating oil composition.

When the sulfur content is 0.35% by mass or less based on the total amount of the lubricating oil composition, the lubricating oil composition tends to have good copper corrosion resistance and oxidation stability.

The sulfur content of the lubricating oil composition can be adjusted by adjusting the content of additives containing sulfur atoms, such as the molybdenum-based friction modifier (B) and the metal-based detergent (C).

Here, from the viewpoint of facilitating the improvement of copper corrosion resistance and oxidation stability, the sulfur content in the lubricating oil composition is preferably 0.33% by mass or less, more preferably 0.31% by mass or less, and still more preferably 0.30% by mass or less, and is preferably 0.25% by mass or more.

(Phosphorus Content)

The lubricating oil composition of the present embodiment is required to have a phosphorus content of more than 0.04% by mass and less than 0.10% by mass based on the total amount of the lubricating oil composition.

When the phosphorus content of the lubricating oil composition is 0.04% by mass or less, the oxidation stability of the lubricating oil composition cannot be improved. Moreover, when the phosphorus content of the lubricating oil composition is 0.10% by mass or more, high-temperature detergency cannot be improved.

The phosphorus content of the lubricating oil composition can be adjusted by adjusting the content of additives containing phosphorus atoms such as phosphorus-based antiwear agents (preferably zinc dialkyldithiophosphate (ZnDTP)).

Here, from the viewpoint of facilitating the exhibition of the effects of the present invention, the phosphorus content in the lubricating oil composition is preferably 0.05% by mass or more, more preferably 0.06% by mass or more, and is preferably 0.09% by mass or less, more preferably 0.08% by mass or less.

The upper and lower limits of these numerical ranges can be combined arbitrarily. Specifically, the phosphorus content in the lubricating oil composition is preferably 0.05% by mass or more and 0.09% by mass or less, more preferably 0.06% by mass or more and 0.08% by mass or less.

(Molybdenum Content)

In the lubricating oil composition of the present embodiment, the molybdenum content based on the total amount of the lubricating oil composition is, from the viewpoint of improving the friction reducing effect, preferably 0.05% by mass or more, more preferably 0.06% by mass or more, and still more preferably 0.07% by mass or more.

In addition, the content of molybdenum atoms based on the total amount of the lubricating oil composition is, from the viewpoint of decreasing the sulfated ash content, preferably 0.12% by mass or less, more preferably 0.11% by mass or less, and still more preferably 0.10% by mass or less.

The upper and lower limits of these numerical ranges can be combined arbitrarily. Specifically, the content of molybdenum atoms based on the total amount of the lubricating oil composition is preferably 0.05% by mass or more and 0.12% by mass or less, more preferably 0.06% by mass or more and 0.11% by mass or less, and still more preferably 0.07% by mass or more and 0.10% by mass or less.

(Calcium Content)

In the lubricating oil composition of the present embodiment, the calcium content based on the total amount of the lubricating oil composition is, from the viewpoint of facilitating the improvement of high-temperature detergency, preferably 0.10% by mass or more, more preferably 0.11% by mass or more.

In addition, from the viewpoint of decreasing the sulfated ash content and preventing LSPI (abnormal combustion), the calcium content based on the total amount of the lubricating oil composition is preferably 0.20% by mass or less, more preferably 0.15% by mass or less, and still more preferably 0.13 mass % or less.

The upper and lower limits of these numerical ranges can be combined arbitrarily. Specifically, the calcium content based on the total amount of the lubricating oil composition is preferably 0.10% by mass or more and 0.20% by mass or less, more preferably 0.10% by mass or more and 0.15% by mass or less, and still more preferably 0.11% by mass or more and 0.13% by mass or less.

(Magnesium Content)

In the lubricating oil composition of the present embodiment, the magnesium content based on the total amount of the lubricating oil composition is preferably 0.03% by mass or more, more preferably 0.04% by mass or more, from the viewpoint of facilitating the improvement of high-temperature detergency.

In addition, from the viewpoint of decreasing the sulfated ash content and preventing LSPI (abnormal combustion), the magnesium content based on the total amount of the lubricating oil composition is preferably 0.07% by mass or less, more preferably 0.06% by mass or less.

The upper and lower limits of these numerical ranges can be combined arbitrarily. Specifically, the magnesium content based on the total amount of the lubricating oil composition is preferably 0.03% by mass or more and 0.07% by mass or less, more preferably 0.04% by mass or more and 0.06% by mass or less.

(Nitrogen Content)

In the lubricating oil composition of the present embodiment, the nitrogen content based on the total amount of the lubricating oil composition is, from the viewpoint of facilitating the improvement of high-temperature detergency and dispersibility, preferably 0.03% by mass or more, more preferably 0.05% by mass or more, and still more preferably 0.08% by mass or more, and is preferably 0.20% by mass or less, more preferably 0.18% by mass or less, and still more preferably 0.15% by mass or less.

The upper and lower limits of these numerical ranges can be combined arbitrarily. Specifically, the nitrogen content based on the total amount of the lubricating oil composition is preferably 0.03% by mass or more and 0.20% by mass or less, more preferably 0.05% by mass or more and 0.18% by mass or less, and still more preferably 0.08% by mass or more and 0.15% by mass or less.

(Boron Content)

In the lubricating oil composition of the present embodiment, the boron content based on the total amount of the lubricating oil composition is, from the viewpoint of facilitating the improvement of high-temperature detergency and dispersibility, preferably 0.0010% by mass or more and 0.10% by mass or less, more preferably 0.0030% by mass or more and 0.080% by mass or less, and still more preferably 0.0050% by mass or more and 0.050% by mass or less.

<Increase Rate of Acid Value after ISOT Test>

The lubricating oil composition of the present embodiment preferably has an increase rate of acid value of 55% or less, more preferably 40% or less, and still more preferably 30% or less, after an ISOT test (165.5° C., 72 hours) performed by a method described in Examples below.

<Increase Rate of Base Number after ISOT Test>

The lubricating oil composition of the present embodiment preferably has a decrease rate of base number of 35% or less, more preferably 30% or less, and still more preferably 25% or less, after the ISOT test (165.5° C., 72 hours) performed by the method described in Examples below.

<Copper Elution Amount after ISOT Test>

The lubricating oil composition of the present embodiment preferably has a copper elution amount of 130 mass ppm or less, more preferably 100 mass ppm or less, and still more preferably 80 mass ppm or less, after the ISOT test (165.5° C., 72 hours) performed by the method described in Examples below.

<Score in Hot Tube Test>

The lubricating oil composition of the present embodiment has a score of preferably 6.0 or higher, more preferably 6.5 or higher in a hot tube test (280° C.) performed by the method described in Examples below.

[Method of Producing Lubricating Oil Composition]

The method of producing the lubricating oil composition of the present embodiment is not particularly limited.

For example, the method of producing the lubricating oil composition of the present embodiment includes a step of mixing the base oil (A), the molybdenum-based friction modifier (B), the metal-based detergent (C), and the ash-free dispersant (D).

The molybdenum-based friction modifier (B) contains two or more selected from the group consisting of the binuclear molybdenum dithiocarbamate (B1), the trinuclear molybdenum dithiocarbamate (B2), and the molybdenum-amine complex (B3).

The metal-based detergent (C) contains a sulfur atom.

The ash-free dispersant (D) contains a nitrogen atom.

The acid value derived from the binuclear molybdenum dithiocarbamate (B1) and the trinuclear molybdenum dithiocarbamate (B2) is less than 0.04 mgKOH/g.

The content ratio of the sulfur content ($C_S$) derived from the metal-based detergent (C) to the nitrogen content ($D_N$) derived from the ash-free dispersant (D), $[(C_S)/(D_N)]$ is adjusted to be 0.30 to 0.85 in terms of mass ratio, and the phosphorus content based on the total amount of the lubricating oil composition is adjusted to be more than 0.04% by mass and less than 0.10% by mass.

The production method may further include a step of blending one or more selected from other components as necessary.

The method of mixing each component is not particularly limited, and examples thereof include a method of blending each component (the component (B), the component (C), the component (D), and one or more selected from other components) with the base oil (A). Further, each component may be blended after adding a diluent oil or the like to form a solution (dispersion). After blending each component, it is preferable to stir and uniformly disperse the components by a known method.

[Use of Lubricating Oil Composition]

The lubricating oil composition of the present embodiment has, even while exhibiting an excellent friction reducing effect, excellent high-temperature detergency, oxidation stability and copper corrosion resistance.

Therefore, the lubricating oil composition of the present embodiment is preferably used in internal combustion engines, more preferably in automobile engines, and even more preferably in gasoline engines.

In addition, the lubricating oil composition of the present embodiment exerts an excellent friction reducing effect even in a temperature environment of 30° C. Therefore, it can be suitably used in an engine of an automobile equipped with a hybrid mechanism and an engine of an automobile equipped with an idling stop mechanism.

Therefore, the lubricating oil composition of the present embodiment provides the following (1) to (5).

(1) A method of using the lubricating oil composition of the present embodiment in an internal combustion engine.

(2) A method of using the lubricating oil composition of the present embodiment in an automobile engine.

(3) A method of using the lubricating oil composition of the present embodiment in a gasoline engine.

(4) A method of using the lubricating oil composition of the present embodiment in an engine of an automobile equipped with a hybrid mechanism.

(5) A method of using the lubricating oil composition of the present embodiment in an engine of an automobile equipped with an idling stop mechanism.

[Lubricating Method Using Lubricating Oil Composition]

As described for the use of the lubricating oil composition, the lubricating oil composition of the present embodiment is preferably used in internal combustion engines, more preferably in automobile engines, and even more preferably in gasoline engines. In addition, the lubricating oil composition of the present embodiment exhibits an excellent friction reducing effect even in a temperature environment of 30° C. Therefore, the lubricating oil composition of the present embodiment can be suitably used in an engine of an automobile equipped with a hybrid mechanism and an engine of an automobile equipped with an idling stop mechanism.

Therefore, the lubricating oil composition of the present embodiment provides the following (6) to (10).

(6) A method of lubricating an internal combustion engine using the lubricating oil composition of the present embodiment.

(7) A method of lubricating an automobile engine using the lubricating oil composition of the present embodiment.

(8) A method of lubricating a gasoline engine using the lubricating oil composition of the present embodiment.

(9) A method of lubricating an engine of an automobile equipped with a hybrid mechanism, using the lubricating oil composition of the present embodiment.

(10) A method for lubricating an engine of an automobile equipped with an idling stop mechanism, using the lubricating oil composition of the present embodiment.

[Internal Combustion Engine Containing Lubricating Oil Composition]

Examples of another embodiment includes an internal combustion engine containing the lubricating oil composition of the present embodiment, preferably an internal combustion engine (engine) containing the lubricating oil composition of the present embodiment as an engine oil. Examples of the internal combustion engine include automobile engines, preferably gasoline engines. Moreover, an engine of an automobile equipped with a hybrid mechanism and an engine of an automobile equipped with an idling stop mechanism are also preferable.

[One Aspect of the Present Invention Provided]

According to one aspect of the present invention, the following [1] to are provided.

[1] A lubricating oil composition containing a base oil (A), a molybdenum-based friction modifier (B), a metal-based detergent (C), and an ash-free dispersant (D), wherein the molybdenum-based friction modifier (B) contains two or more selected from a group consisting of a binuclear molybdenum dithiocarbamate (B1), a trinuclear molybdenum dithiocarbamate (B2), and a molybdenum-amine complex (B3), the metal-based detergent (C) contains a sulfur atom, the ash-free dispersant (D) contains a nitrogen atom, an acid value derived from the binuclear molybdenum dithiocarbamate (B1) and the trinuclear molybdenum dithiocarbamate (B2) is less than 0.04 mgKOH/g, a content ratio of a sulfur content ($C_S$) derived from the metal-based detergent (C) to a nitrogen content ($D_N$) derived from the ash-free dispersant (D), [$(C_S)/(D_N)$] is 0.30 to 0.85 in terms of mass ratio, and a phosphorus content based on a total amount of the lubricating oil composition is more than 0.04% by mass and less than 0.10% by mass.

[2] The lubricating oil composition according to the above [1], wherein the sulfur content based on the total amount of the lubricating oil composition is 0.35% by mass or less.

[3] The lubricating oil composition according to the above [1] or [2], wherein the phosphorus content based on the total amount of the lubricating oil composition is 0.06% by mass to 0.08% by mass.

[4] The lubricating oil composition according to any one of the above [1] to [3], wherein the molybdenum content based on the total amount of the lubricating oil composition is 0.05% by mass to 0.12% by mass.

[5] The lubricating oil composition according to any one of the above [1] to [4], wherein the metal-based detergent (C) contains one or more selected from a group consisting of a calcium-based detergent (C1) and a magnesium-based detergent (C2).

[6] The lubricating oil composition according to the above [5], wherein the metal-based detergent (C) contains the calcium-based detergent (C1), and the calcium content based on the total amount of the lubricating oil composition is 0.10% by mass to 0.20% by mass.

[7] The lubricating oil composition according to the above [5], wherein the metal-based detergent (C) contains the magnesium-based detergent (C2), and the magnesium content based on the total amount of the lubricating oil composition is 0.03% by mass to 0.07% by mass.

[8] The lubricating oil composition according to the above [5], wherein the metal-based detergent (C) contains the calcium-based detergent (C1) and the magnesium-based detergent (C2), the calcium content based on the total amount of the lubricating oil composition is 0.10% by mass to 0.20% by mass, and the magnesium content based on the total amount of the lubricating oil composition is 0.03% by mass to 0.07% by mass.

[9] The lubricating oil composition according to any of the above [1] to [8], wherein the binuclear molybdenum dithiocarbamate (B1) is a compound represented by the following general formula (b1-3).

(b1-3)

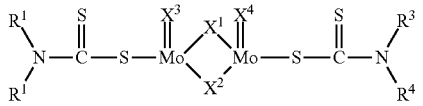

[In the general formula (b1-3), $R^1$, $R^2$, $R^3$, and $R^4$ each independently represent a group of short-chain substituent groups (α) which are aliphatic hydrocarbon groups having 4 to 12 carbon atoms or a group of long-chain substituent groups (β) which are aliphatic hydrocarbon groups having 13 to 22 carbon atoms, provided that a molar ratio between the group of short-chain substituent groups (α) and the group of long-chain substituent groups (β) in a total molecule of the compound (B1), [(α)/(β)] is 0.10 to 2.0. Further, in the general formula (b1-3), X1, X2, X3 and X4 each independently represent an oxygen atom or a sulfur atom.]

[10] The lubricating oil composition according to any of the above [1] to [9], further containing a metal deactivator (E).

[11] The lubricating oil composition according to any of the above [1] to [10], wherein the ash-free friction modifier content based on the total amount of the lubricating oil composition is less than 0.1% by mass.

[12] The lubricating oil composition according to any of the above [1] to [11], which is used in an internal combustion engine.

[13] An internal combustion engine containing the lubricating oil composition according to any of the above [1] to [11].

[14] A method of lubricating an internal combustion engine using the lubricating oil composition according to any of the above [1] to [11].

[15] A method of producing a lubricating oil composition, including a step of mixing a base oil (A), a molybdenum-based friction modifier (B), a metal-based detergent (C), and an ash-free dispersant (D), wherein the molybdenum-based friction modifier (B) contains two or more selected from a group consisting of a binuclear molybdenum dithiocarbamate (B1), a trinuclear molybdenum dithiocarbamate (B2), and a molybdenum-amine complex (B3), the metal-based detergent (C) contains a sulfur atom, the ash-free dispersant (D) contains a nitrogen atom, an acid value derived from the binuclear molybdenum dithiocarbamate (B1) and the trinuclear molybdenum dithiocarbamate (B2) is less than 0.04 mgKOH/g, a content ratio of a sulfur content ($C_S$) derived from the metal-based detergent (C) to a nitrogen content ($D_N$) derived from the ash-free dispersant (D), [$(C_S)/(D_N)$] is adjusted to be 0.30 to 0.85 in terms of mass ratio, and a phosphorus content based on a total amount of the lubricating oil composition is adjusted to be more than 0.04% by mass and less than 0.10% by mass.

EXAMPLES

The present invention will be described in more detail with reference to Examples below; however, the present invention is not limited to the Examples.

[Methods of Measuring Various Physical Property Values]

Raw materials used in each Example and each Comparative Example and the properties of the lubricating oil compositions of each Example and each Comparative Example were measured according to the following procedures.

(1) Kinematic Viscosity, Viscosity Index

The kinematic viscosity at 40° C., the kinematic viscosity at 100° C., and the viscosity index of the base oil and the lubricating oil composition were measured or calculated according to JIS K2283:2000.

(2) CCS Viscosity at −35° C.

The CCS viscosity of the lubricating oil composition at −35° C. was measured according to JIS K2010:1993.

(3) HTHS Viscosity at 150° C.

The HTHS viscosity of the lubricating oil composition at 150° C. was measured at a temperature of 150° C. and a shear rate of $10^6$/s using a TBS high temperature viscometer (Tapered Bearing Simulator Viscometer) in accordance with ASTM D4683.

(4) Acid Value of Lubricating Oil Composition

The acid value of the lubricating oil composition was measured according to JIS K2501:2003 (potentiometric titration method).

(5) Base Number of Lubricating Oil Composition

The base number of the lubricating oil composition was measured by a potentiometric titration method (base number/perchloric acid method) according to JIS K2501:2003-9.

(6) Molybdenum Content, Boron Content, Calcium Content, Magnesium Content, Phosphorus Content, and Sulfur Content The molybdenum content, boron content, calcium content, magnesium content, phosphorus content, and sulfur content of the lubricating oil composition were measured according to JIS-5S-38-03.

(7) Nitrogen Content

The nitrogen content of the lubricating oil composition was measured by a chemiluminescence method in accordance with JIS K2609:1998.

(8) Base Number of Metal-Based Detergent

The base number of the metal-based detergent was measured by the potentiometric titration method (base number/perchloric acid method) in accordance with JIS K2501: 2003-9.

(9) Acid Values Derived From Binuclear Molybdenum Dithiocarbamate (B1) and Trinuclear Molybdenum Dithiocarbamate (B2)

The acid values derived from the binuclear molybdenum dithiocarbamate (B1) and the trinuclear molybdenum dithiocarbamate (B2) were measured according to JIS K2501: 2003 (potentiometric titration method).

Specifically, the acid value derived from the binuclear molybdenum dithiocarbamate (B1) and the acid value derived from the trinuclear molybdenum dithiocarbamate (B2) were each measured according to JIS K2501: 2003 (potentiometric titration method), and the acid values were calculated in consideration of each content.

(10) Mass Average Molecular Weight (Mw), Molecular Weight Distribution (Mw/Mn)

To a "1515 isocratic HPLC pump" and a "2414 differential refractive index (RI) detector" manufactured by Waters Corporation, one column "TSKguardcolumn SuperHZ-L", and two columns "TSK SuperMultipore HZ-M" manufactured by Tosoh Corporation were attached in this order from an upstream side, and measurement was conducted under the conditions of a measurement temperature at 40° C., a mobile phase of tetrahydrofuran, a flow rate of 0.35 mL/min, and a sample concentration of 1.0 mg/mL to calculate the mass average molecular weight (Mw) and molecular weight distribution (Mw/Mn) in terms of standard polystyrene.

Examples 1 to 6, Comparative Examples 1 to 7

The components shown below were added in the amounts shown in Table 1 and thoroughly mixed to obtain lubricating oil compositions.

The details of each component used in Examples 1 to 6 and Comparative Examples 1 to 7 are as follows.

<Base Oil (A)>

"Mineral Oil"

Categorization in API category: Group III, kinematic viscosity at 100° C.: 4.3 $mm^2/s$, viscosity index: 123

<Molybdenum-Based Friction Modifier (B)>

"Binuclear Molybdenum Dithiocarbamate (B1)-1"

The binuclear molybdenum dithiocarbamate (B1)-1 (hereinafter also referred to as "binuclear MoDTC (B1)-1") is a compound that substantially has no group of short-chain substituent groups (α) and substantially consists of the group of long-chain substituent groups (β) in the general formula (b1-3), where the aliphatic hydrocarbon group of the group of long-chain substituent groups (β) has 13 carbon atoms. In the general formula (b1-3), $X^1$, $X^2$, $X^3$ and $X^4$ are sulfur atoms.

"Binuclear Molybdenum Dithiocarbamate (B1)-2"

The binuclear molybdenum dithiocarbamate (B1)-2 (hereinafter also referred to as "binuclear MoDTC (B1)-2") is a compound in which the aliphatic hydrocarbon group of the group of short-chain substituent groups (α) has 8 carbon atoms and the aliphatic hydrocarbon group of the group of long-chain substituent groups (β) has 13 carbon atoms in the general formula (b1-3). In the general formula (b1-3), $X^1$, $X^2$, $X^3$ and $X^4$ are sulfur atoms. The molar ratio between the group of short-chain substituent groups (a) and the group of long-chain substituent groups (β), [(α)/(β)] in the total molecule of MoDTC-1 is 1.0.

"Trinuclear Molybdenum Dithiocarbamate (B2)"

As the trinuclear molybdenum dithiocarbamate (B2) (hereinafter also referred to as "trinuclear MoDTC (B2)"), a trinuclear molybdenum dithiocarbamate having a molybdenum atom content of 5.3% by mass was used.

"Molybdenum Amine Complex (B3)"

A dialkylamine molybdate (molybdenum content: 7.9% by mass) was used as the molybdenum amine complex (B3).

In Examples 3 to 5 and Comparative Examples 4 to 7, the molar ratio between the group of short-chain substituent groups (α) and the group of long-chain substituent groups (ß), [(α)/(ß)] in the total molecule of the binuclear MoDTC (B1)-1 and the binuclear MoDTC (B1)-2 is 0.48.

Further, in Comparative Example 3, the molar ratio between the group of short-chain substituent groups (α) and the group of long-chain substituent groups (ß), [(α)/(ß)] in the total molecule of the binuclear MoDTC (B1)-1 and the binuclear MoDTC (B1)-2 is 0.31.

<Metal-Based Detergent (C)>

"Calcium Sulfonate"

Base number: 300 mgKOH/g, calcium content: 11.7% by mass

"Magnesium Sulfonate 1"

Base number: 400 mgKOH/g, magnesium content: 9.5% by mass

"Magnesium Sulfonate 2"

Base number: 400 mgKOH/g, magnesium content: 9.7% by mass

<Metal-Based Detergent (C')>

"Calcium Salicylate"

Base number: 230 mgKOH/g, calcium content: 8.0% by mass

<Ash-Free Dispersant (D)>

"Non-Boron-Modified Polybutenylsuccinic Monoimide 1"

Nitrogen content: 1.4% by mass

"Non-Boron-Modified Polybutenylsuccinic Monoimide 2"

Nitrogen content: 1.0% by mass

"Boron-Modified Polybutenylsuccinic Bisimide 1"

Boron content: 2.2% by mass, nitrogen content: 1.2% by mass

"Boron-Modified Polybutenylsuccinic Bisimide 2"

Boron content: 1.4% by mass, nitrogen content: 1.3% by mass

<Metal Deactivator (E)>

As the metal deactivator, 1-[N, N-bis(2-ethylhexyl)aminomethyl]-4-methyl-1H-benzotriazole, which is a benzotriazole compound, was used.

[Chem. 10]

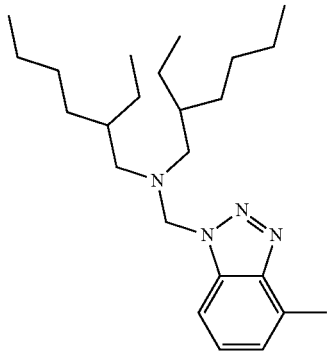

1-[N,N-bis(2-ethylhexyl)aminomethyl]-4-methyl-1H-benzotriazole is a compound in which, in a general formula (e1), $R^{e1}$ is a methyl group, p is 1, $R^{e2}$ is a methylene group, and $R^{e3}$ and $R^{e4}$ are 2-ethylhexyl groups.

<Other Additives>

(Viscosity Index Improver)

"Non-Dispersion Type Polymethacrylate"

Mass average molecular weight (Mw): 400,000, molecular weight distribution (Mw/Mn): 1.7

"Styrene-Isoprene Copolymer"

Mass average molecular weight (Mw): 600,000, molecular weight distribution (Mw/Mn): 1.1

(Zinc Dialkylthiophosphate (ZnDTP))

Phosphorus content: 6.7% by mass, zinc content: 7.4% by mass (Others)

Amine-based antioxidant (diphenylamine)

Phenol-based antioxidant

Pour point depressant

Ash-free friction modifier (glycerin monooleate)

[Evaluation Method]

The tests described below were carried out to evaluate the oxidation stability, high-temperature detergency, copper corrosion resistance, and reduction in the friction coefficient.

<ISOT Test>

A copper piece and an iron piece were added as catalysts to a test oil (prepared lubricating oil composition), and an ISOT test in accordance with JIS K2514-1:2013 was conducted to forcefully deteriorate the test oil. The test temperature was 165.5° C. The acid value and base number were measured for the test oil 72 hours after the start of the ISOT test.

Then, an increase rate ($AN_i$) of the acid value of the lubricating oil composition after the ISOT test relative to the acid value of the lubricating oil composition before the ISOT test (hereinafter simply referred to as "increase rate of acid value (ANi)") was calculated according to the following equation (I).

$$(AN_i)=[(AN_n)-(AN_0)]/(AN_0)\times 100 \quad \text{(I)}$$

In the above equation (I), $AN_n$ is the acid value of the lubricating oil composition after the ISOT test, and $AN_0$ is the acid value of the lubricating oil composition before the ISOT test.

A lubricating oil composition with a smaller increase rate of acid value ($AN_i$) can be said to be a lubricating oil composition with better oxidation stability. In the present example, lubricating oil compositions with an increase rate of acid value ($AN_i$) of 55% or less were accepted.

Further, a decrease rate of the base number ($TBN_d$) of the lubricating oil composition after the ISOT test relative to the base number of the lubricating oil composition before the ISOT test (hereinafter simply referred to as "decrease rate of base number ($TBN_d$)") was calculated according to the following equation (II).

$$(TBN_d)=[(TBN_0)-(TBN_n)]/(TBN_0)\times 100 \quad \text{(II)}$$

In the above equation (II), $TBN_n$ is the base number of the lubricating oil composition after the ISOT test, and $TBN_0$ is the base number of the lubricating oil composition before the ISOT test.

A lubricating oil composition with a smaller decrease rate of base number ($TBN_d$) can be said to be a lubricating oil composition with excellent high-temperature detergency.

In the present example, lubricating oil compositions with a decrease rate of base number ($TBN_d$) of 35% or less were accepted.

<Copper Elution Evaluation after ISOT Test>

The copper concentration of the test oil forcedly deteriorated by the ISOT test was measured according to JPI-5S-44-11, and the measured value was taken as the copper elution amount after the ISOT test.

It can be said that the smaller the copper elution amount after the ISOT test, the more excellent the copper corrosion resistance of the lubricating oil composition.

In the present example, lubricating oil compositions with a copper elution amount of 130 ppm by mass or less after the ISOT test were accepted.

<Hot Tube Test>

A hot tube test was performed on the test oil (prepared lubricating oil composition) at a test temperature of 280° C. in accordance with JPI-5S-55-99.

After the test, lacquer adhered to a test tube was evaluated on an 11-point scale from 0 point (black) to 10 point (colorless) in accordance with JPI-5S-55-99.

The higher the score, the less deposits and the better the detergency.

In the present example, lubricating oil compositions with a score of more than 5.5 were accepted.

<SRV Test>

An SRV tester (manufactured by Optimol Instruments Prüftechnik GmbH) was used to measure the friction coefficient under the following conditions when the prepared lubricating oil composition was used.

Cylinder: AISI52100
Disk: AISI52100
Frequency: 50 Hz
Amplitude: 1.5 mm
Load: 400N
Temperature: 30° C.
Test time: 20 minutes (an average of the last minute was used as the friction coefficient)

Then, by dividing a "difference between the friction coefficient of each lubricating oil composition and the friction coefficient of the lubricating oil composition of Comparative Example 1" by a "friction coefficient of the lubricating oil composition of Comparative Example 1", the decrease rate (%) from the friction coefficient of Comparative Example 1 was calculated for the friction coefficient of each lubricating oil composition.

The greater the decrease rate from the friction coefficient of Comparative Example 1, the more excellent the effect of decreasing the friction coefficient.

In the present example, lubricating oil compositions with a decrease rate of 10% or more from the friction coefficient of Comparative Example 1 were accepted.

The results are shown in Table 1.

TABLE 1

| | | | Comp. Ex. 1 | Comp. Ex. 2 | Comp. Ex. 3 | Comp. Ex. 4 | Comp. Ex. 5 | Comp. Ex. 6 | Comp. Ex. 7 |
|---|---|---|---|---|---|---|---|---|---|
| Composition of lubricating oil composition (Unit: % by mass) | Base oil (A) | 100N mineral oil | Balance | Balance | Balance | Balance | Balance | Balance | Balance |
| | Molybdenum-based friction modifier (B) | Binuclear MoDTC (B1)-1 | | 0.70 | 0.40 | 0.30 | 0.30 | 0.30 | 0.30 |
| | | Binuclear MoDTC (B1)-2 | 0.70 | | 0.36 | 0.36 | 0.36 | 0.36 | 0.36 |
| | | Trinuclear MoDTC (B2) | | 0.15 | 0.15 | 0.15 | 0.15 | 0.15 | 0.15 |
| | | Molybdenum-amine complex (B3) | | | | | | | |
| | Metal-based detergent (C) | Ca-sulfonate | | 1.00 | 1.00 | 0.50 | 1.00 | 1.00 | 1.00 |
| | | Mg-sulfonate-1 | | 0.50 | 0.75 | 0.25 | 0.50 | 0.50 | 0.50 |
| | | Mg-sulfonate-2 | 0.40 | | | | | | |
| | Metal-based detergent (C') | Ca-salicylate | 1.60 | | | | | | |
| | Ash-free dispersant (D) | Non-boron-modified polybutenylsuccinic monoimide 1 | | 3.00 | 3.00 | 3.00 | 1.50 | 3.00 | 3.00 |
| | | Non-boron-modified polybutenylsuccinic monoimide 2 | 1.00 | | | | | | |
| | | Boron-modified polybutenylsuccinic bisimide 1 | | 0.30 | 0.30 | 0.30 | 0.30 | 0.30 | 0.30 |
| | | Boron-modified polybutenylsuccinic bisimide 2 | 2.00 | | | | | | |
| | Metal deactivator (E) | Benzotriazole compound | | 0.01 | 0.01 | 0.01 | 0.01 | 0.01 | 0.01 |
| | Other additives | ZnDTP | 1.11 | 1.11 | 1.11 | 1.11 | 1.11 | 0.51 | 1.54 |
| | | Non-dispersion type polymethacrylate | x | 1.53 | 1.53 | 1.53 | 1.53 | 1.53 | 1.53 |
| | | Styrene-isoprene copolymer | x | 0.08 | 0.08 | 0.08 | 0.08 | 0.08 | 0.08 |
| | | Amine-based antioxidant | 1.20 | 0.87 | 0.87 | 0.87 | 0.87 | 0.87 | 0.87 |
| | | Phenol-based antioxidant | | 0.50 | 0.50 | 0.50 | 0.50 | 0.50 | 0.50 |
| | | Pour point depressant | 0.10 | 0.10 | 0.10 | 0.10 | 0.10 | 0.10 | 0.10 |
| | | Glycerin monooleate | 0.30 | | | | | | |
| | Total | | 100.00 | 100.00 | 100.00 | 100.00 | 100.00 | 100.00 | 100.00 |
| Properties of lubricating oil composition | Kinetic viscosity at 40° C. (Unit: $mm^2/s$) | | 34.0 | 35.6 | 35.9 | 35.3 | 33.6 | 35.6 | 35.8 |
| | Kinetic viscosity at 100° C. (Unit: $mm^2/s$) | | 8.00 | 8.32 | 8.32 | 8.21 | 7.93 | 8.29 | 8.30 |
| | Viscosity index | | 221 | 224 | 224 | 222 | 216 | 225 | 223 |
| | CCS viscosity at −35° C. (Unit: mPa · s) | | 5000 | 5200 | 5250 | 5200 | 4800 | 5200 | 5300 |
| | HTHS viscosity at 150° C. (Unit: mPa · s) | | 2.6 | 2.6 | 2.6 | 2.6 | 2.6 | 2.6 | 2.6 |
| | Acid value (Unit: mgKHO/g) | | 2.3 | 1.87 | 1.7 | 1.5 | 1.6 | 1 | 2.2 |
| | Base number (perchloric acid method, Unit: mgKHO/g) | | 7.5 | 7.5 | 8.3 | 4.8 | 6.9 | 7.4 | 7.4 |
| | Mo content (Unit: % by mass) | | 0.07 | 0.08 | 0.09 | 0.08 | 0.08 | 0.08 | 0.08 |
| | N content (Unit: % by mass) | | 0.09 | 0.09 | 0.09 | 0.09 | 0.07 | 0.09 | 0.09 |
| | B content (Unit: % by mass) | | 0.03 | 0.01 | 0.01 | 0.01 | 0.01 | 0.01 | 0.01 |
| | Ca content (Unit: % by mass) | | 0.14 | 0.12 | 0.12 | 0.06 | 0.12 | 0.12 | 0.12 |
| | Mg content (Unit: % by mass) | | 0.04 | 0.05 | 0.07 | 0.03 | 0.05 | 0.05 | 0.05 |
| | P content (Unit: % by mass) | | 0.07 | 0.07 | 0.07 | 0.07 | 0.07 | 0.04 | 0.10 |
| | S content (Unit: % by mass) | | 0.23 | 0.29 | 0.30 | 0.27 | 0.29 | 0.20 | 0.36 |
| Other properties | S content derived from metal-based detergent (Cs, Unit: % by mass) | | 0.01 | 0.02 | 0.03 | 0.01 | 0.02 | 0.02 | 0.02 |
| | N content derived from ash-free dispersant (Dn, Unit: % by mass) | | 0.036 | 0.046 | 0.046 | 0.046 | 0.025 | 0.046 | 0.046 |
| | $(C_S)/(D_N)$] | | 0.34 | 0.52 | 0.60 | 0.26 | 0.97 | 0.52 | 0.52 |
| | Acid value derived from MoDTC (Unit: mgKOH/g) | | 0.00 | 0.06 | 0.04 | 0.03 | 0.03 | 0.03 | 0.03 |
| | S content derived from MoDTC (Unit: % by mass) | | 0.076 | 0.095 | 0.099 | 0.088 | 0.088 | 0.088 | 0.088 |

TABLE 1-continued

| | | | | | | | | |
|---|---|---|---|---|---|---|---|---|
| Evaluation | Increase rate of acid value after ISOT (165.5° C. after 72 hours) (Unit: %) | 32 | 93 | 78 | 94 | 7 | 106 | 51 |
| | Decrease rate of base number after ISOT (Unit: %) | 23 | 56 | 21 | 41 | 16 | 33 | 35 |
| | Cu elution amount after ISOT (Unit: mass ppm) | 49 | 772 | 467 | 34 | 277 | 27 | 124 |
| | Hot tube test (280° C.) score | 6.5 | 6.0 | 6.0 | 5.5 | 3.5 | 7.5 | 5.5 |
| | Friction coefficient (30° C.), decrease rate from standard (Unit: %) | Standard | 17 | 2 | 17 | 12 | 19 | 23 |

| | | | Ex. 1 | Ex. 2 | Ex. 3 | Ex. 4 | Ex. 5 | Ex. 6 |
|---|---|---|---|---|---|---|---|---|
| Composition of lubricating oil composition (Unit: % by mass) | Base oil (A) | 100N mineral oil | Balance | Balance | Balance | Balance | Balance | Balance |
| | Molybdenum-based friction modifier (B) | Binuclear MoDTC (B1)-1 | | | 0.30 | 0.30 | 0.30 | |
| | | Binuclear MoDTC (B1)-2 | 0.70 | 0.60 | 0.36 | 0.36 | 0.36 | 0.70 |
| | | Trinuclear MoDTC (B2) | 0.15 | 0.15 | 0.15 | 0.15 | 0.15 | |
| | | Molybdenum-amine complex (B3) | | 0.18 | | | | 0.18 |
| | Metal-based detergent (C) | Ca-sulfonate | 1.00 | 1.00 | 1.00 | 1.50 | 1.00 | 1.00 |
| | | Mg-sulfonate-1 | 0.50 | 0.50 | 0.50 | 0.75 | 0.50 | 0.10 |
| | | Mg-sulfonate-2 | | | | | | |
| | Metal-based detergent (C') | Ca-salicylate | | | | | | |
| | Ash-free dispersant (D) | Non-boron-modified polybutenylsuccinic monoimide 1 | 3.00 | 3.00 | 3.00 | 3.00 | 4.50 | 3.00 |
| | | Non-boron-modified polybutenylsuccinic monoimide 2 | | | | | | |
| | | Boron-modified polybutenylsuccinic bisimide 1 | 0.30 | 0.30 | 0.30 | 0.30 | 0.30 | 0.30 |
| | | Boron-modified polybutenylsuccinic bisimide 2 | | | | | | |
| | Metal deactivator (E) | Benzotriazole compound | 0.01 | 0.01 | 0.01 | 0.01 | 0.01 | 0.01 |
| | Other additives | ZnDTP | 1.11 | 1.11 | 1.11 | 1.11 | 1.11 | 1.11 |
| | | Non-dispersion type polymethacrylate | 1.53 | 1.53 | 1.53 | 1.53 | 1.53 | 1.53 |
| | | Styrene-isoprene copolymer | 0.08 | 0.08 | 0.08 | 0.08 | 0.08 | 0.08 |
| | | Amine-based antioxidant | 0.87 | 0.87 | 0.87 | 0.87 | 0.87 | 0.87 |
| | | Phenol-based antioxidant | 0.50 | 0.50 | 0.50 | 0.50 | 0.50 | 0.50 |
| | | Pour point depressant | 0.10 | 0.10 | 0.10 | 0.10 | 0.10 | 0.10 |
| | | Glycerin monooleate | | | | | | |
| | Total | | 100.00 | 100.00 | 100.00 | 100.00 | 100.00 | 100.00 |
| Properties of lubricating oil composition | Kinetic viscosity at 40° C. (Unit: $mm^2/s$) | | 35.8 | 35.7 | 35.7 | 36.1 | 38.4 | 35.7 |
| | Kinetic viscosity at 100° C. (Unit: $mm^2/s$) | | 8.32 | 8.30 | 8.30 | 8.37 | 8.74 | 8.30 |
| | Viscosity index | | 224 | 224 | 224 | 225 | 229 | 224 |
| | CCS viscosity at −35° C. (Unit: mPa · s) | | 5200 | 5200 | 5200 | 5300 | 5800 | 5200 |
| | HTHS viscosity at 150° C. (Unit: mPa · s) | | 2.6 | 2.6 | 2.6 | 2.6 | 2.6 | 2.6 |
| | Acid value (Unit: mgKHO/g) | | 1.4 | 1.7 | 1.7 | 1.7 | 1.6 | 1.7 |
| | Base number (perchloric acid method, Unit: mgKHO/g) | | 7.5 | 7.6 | 7.3 | 9.7 | 7.9 | 7.5 |
| | Mo content (Unit: % by mass) | | 0.08 | 0.08 | 0.08 | 0.08 | 0.08 | 0.08 |
| | N content (Unit: % by mass) | | 0.09 | 0.09 | 0.09 | 0.09 | 0.11 | 0.09 |
| | B content (Unit: % by mass) | | 0.01 | 0.01 | 0.01 | 0.01 | 0.01 | 0.01 |
| | Ca content (Unit: % by mass) | | 0.12 | 0.12 | 0.12 | 0.18 | 0.12 | 0.12 |
| | Mg content (Unit: % by mass) | | 0.05 | 0.05 | 0.05 | 0.07 | 0.05 | 0.05 |
| | P content (Unit: % by mass) | | 0.07 | 0.07 | 0.07 | 0.07 | 0.07 | 0.07 |
| | S content (Unit: % by mass) | | 0.29 | 0.29 | 0.29 | 0.30 | 0.29 | 0.29 |

TABLE 1-continued

| | | | | | | | |
|---|---|---|---|---|---|---|---|
| Other properties | S content derived from metal-based detergent (Cs, Unit: % by mass) | 0.02 | 0.02 | 0.02 | 0.04 | 0.02 | 0.02 |
| | N content derived from ash-free dispersant (Dn, Unit: % by mass) | 0.046 | 0.046 | 0.046 | 0.046 | 0.067 | 0.046 |
| | $(C_S)/(D_N)$] | 0.52 | 0.52 | 0.52 | 0.78 | 0.36 | 0.39 |
| | Acid value derived from MoDTC (Unit: mgKOH/g) | 0.01 | 0.01 | 0.03 | 0.03 | 0.03 | 0.00 |
| | S content derived from MoDTC (Unit: % by mass) | 0.089 | 0.078 | 0.088 | 0.088 | 0.088 | 0.076 |
| Evaluation | Increase rate of acid value after ISOT (165.5° C. after 72 hours) (Unit: %) | 31 | 53 | 24 | 51 | 51 | 50 |
| | Decrease rate of base number after ISOT (Unit: %) | 24 | 32 | 20 | 18 | 29 | 30 |
| | Cu elution amount after ISOT (Unit: mass ppm) | 126 | 102 | 50 | 127 | 40 | 80 |
| | Hot tube test (280° C.) score | 6.0 | 6.0 | 6.5 | 6.5 | 6.5 | 6.0 |
| | Friction coefficient (30° C.), decrease rate from standard (Unit: %) | 18 | 18 | 17 | 18 | 19 | 18 |

First, among the results shown in Table 1, when Comparative Example 1 containing one kind of the molybdenum-based friction modifier (B) alone and Comparative Examples 2 to 7 containing plural types of molybdenum-based friction modifiers (B) were compared, it can be seen that in Comparative Examples 2 to 7 containing plural types of molybdenum-based friction modifiers (B), while the friction coefficient is decreased, at least one of oxidation stability, high-temperature detergency, and copper corrosion resistance is inferior.

Then, the results shown in Table 1 reveal the following.

It can be seen that comparing with Comparative Example 1 containing only one kind of the molybdenum-based friction modifier (B), the lubricating oil compositions of Examples 1 to 6 containing plural types of molybdenum-based friction modifiers (B) have a decreased friction coefficient and excellent oxidation stability, high-temperature detergency, and copper corrosion resistance.

In contrast, as in the lubricating oil compositions of Comparative Examples 2 and 3, when the acid value derived from the binuclear molybdenum dithiocarbamate and trinuclear molybdenum dithiocarbamate is 0.04 mgKOH/g or more, it can be seen that at least one of the effect of decreasing the friction coefficient, the effect of improving oxidation stability, the effect of improving high-temperature detergency, and the effect of improving copper corrosion resistance is not exhibited.

As in the lubricating oil composition of Comparative Example 4, it can be seen that when the content ratio of the sulfur content ($C_S$) derived from the metal-based detergent (C) to the nitrogen content ($D_N$) derived from the ash-free dispersant (D), $[(C_S)/(D_N)]$ is less than 0.30, the lubricating oil composition is inferior in oxidation stability and high-temperature detergency.

As in the lubricating oil composition of Comparative Example 5, it can be seen that when the content ratio of the sulfur content ($C_S$) derived from the metal-based detergent (C) to the nitrogen content ($D_N$) derived from the ash-free dispersant (D), $[(C_S)/(D_N)]$ is more than 0.85, the lubricating oil composition is inferior in high-temperature detergency and copper corrosion resistance.

As in the lubricating oil composition of Comparative Example 6, it can be seen that when the phosphorus content is 0.04% by mass or less based on the total amount of the lubricating oil composition, the oxidation stability is inferior.

As in the lubricating oil composition of Comparative Example 7. it can be seen that when the phosphorus content is 0.10% by mass or more based on the total amount of the lubricating oil composition, the high-temperature detergency is inferior.

The invention claimed is:

1. A lubricating oil composition, comprising:

a base oil;

a molybdenum-based friction modifier;

a metal-based detergent; and an ash-free dispersant, wherein the molybdenum-based friction modifier includes two or more selected from the group consisting of a binuclear molybdenum dithiocarbamate, a trinuclear molybdenum dithiocarbamate, and a molybdenum-amine complex, the metal-based detergent includes a sulfur atom, the ash-free dispersant includes a nitrogen atom, an acid value derived from the binuclear molybdenum dithiocarbamate and/or the trinuclear molybdenum dithiocarbamate is less than 0.04 mgKOH/g, a content ratio of a sulfur content derived from the metal-based detergent to a nitrogen content derived from the ash-free dispersant is from 0.30 to 0.85 in terms of mass ratio, and a phosphorus content based on a total amount of the lubricating oil composition is more than 0.04% by mass and less than 0.10% by mass.

2. The lubricating oil composition according to claim 1, wherein the sulfur content based on the total amount of the lubricating oil composition is 0.35% by mass or less.

3. The lubricating oil composition according to claim 1, wherein the phosphorus content based on the total amount of the lubricating oil composition is from 0.06% by mass to 0.08% by mass.

4. The lubricating oil composition according to claim 1, wherein a molybdenum content based on the total amount of the lubricating oil composition is from 0.05% by mass to 0.12% by mass.

5. The lubricating oil composition according to claim 1, wherein the metal-based detergent includes at least one selected from the group consisting of a calcium-based detergent and a magnesium-based detergent.

6. The lubricating oil composition according to claim 5, wherein the metal-based detergent includes the calcium-based detergent, and a calcium content based on the total amount of the lubricating oil composition is from 0.10% by mass to 0.20% by mass.

7. The lubricating oil composition according to claim 5, wherein the metal-based detergent includes the magnesium-based detergent, and a magnesium content based on the total amount of the lubricating oil composition is from 0.03% by mass to 0.07% by mass.

8. The lubricating oil composition according to claim 5, wherein the metal-based detergent includes the calcium-based detergent and the magnesium-based detergent, a calcium content based on the total amount of the lubricating oil composition is from 0.10% by mass to 0.20% by mass, and a magnesium content based on the total amount of the lubricating oil composition is from 0.03% by mass to 0.07% by mass.

9. The lubricating oil composition according to claim 1, wherein the binuclear molybdenum dithiocarbamate is a compound of formula (b1-3), (b1-3)

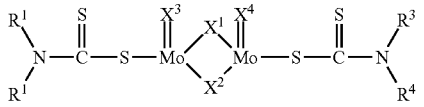

where $R^1$, $R^2$, $R^3$, and $R^4$ are each independently represent a group of short-chain substituent groups which are aliphatic hydrocarbon groups having 4 to 12 carbon atoms or a group of long-chain substituent groups which are aliphatic hydrocarbon groups having 13 to 22 carbon atoms, provided that a molar ratio between the group of short-chain substituent groups and the group of long chain substituent groups in a total molecule of the binuclear molybdenum dithiocarbamate is from 0.10 to 2.0, and $X^1$, $X^2$, $X^3$ and $X^4$ are each independently an oxygen atom or a sulfur atom.

10. The lubricating oil composition according to claim 1, further comprising a metal deactivator.

11. The lubricating oil composition according to claim 1, wherein an ash-free friction modifier content based on the total amount of the lubricating oil composition is less than 0.1% by mass.

12. An internal combustion engine comprising the lubricating oil composition of claim 1.

13. A method of lubricating an internal combustion engine, comprising:

lubricating the internal combustion engine with the lubricating oil composition of claim 1.

14. A method of producing a lubricating oil composition, comprising:

mixing a base oil, a molybdenum-based friction modifier, a metal-based detergent, and an ash-free dispersant, wherein the molybdenum-based friction modifier includes two or more selected from the group consisting of a binuclear molybdenum dithiocarbamate, a trinuclear molybdenum dithiocarbamate, and a molybdenum-amine complex, the metal-based detergent includes a sulfur atom, the ash-free dispersant includes a nitrogen atom, an acid value derived from the binuclear molybdenum dithiocarbamate and/or the trinuclear molybdenum dithiocarbamate is less than 0.04 mgKOH/g, a content ratio of a sulfur content derived from the metal-based detergent to a nitrogen content derived from the ash-free dispersant is adjusted to be from 0.30 to 0.85 in terms of mass ratio, and a phosphorus content based on a total amount of the lubricating oil composition is adjusted to be more than 0.04% by mass and less than 0.10% by mass.

15. The lubricating oil composition according to claim 2, wherein the phosphorus content based on the total amount of the lubricating oil composition is from 0.06% by mass to 0.08% by mass.

16. The lubricating oil composition according to claim 2, wherein a molybdenum content based on the total amount of the lubricating oil composition is from 0.05% by mass to 0.12% by mass.

17. The lubricating oil composition according to claim 2, wherein the metal-based detergent includes at least one selected from the group consisting of a calcium-based detergent and a magnesium-based detergent.

18. The lubricating oil composition according to claim 17, wherein the metal-based detergent includes the calcium-based detergent, and a calcium content based on the total amount of the lubricating oil composition is from 0.10% by mass to 0.20% by mass.

19. The lubricating oil composition according to claim 17, wherein the metal-based detergent includes the magnesium-based detergent, and a magnesium content based on the total amount of the lubricating oil composition is from 0.03% by mass to 0.07% by mass.

20. The lubricating oil composition according to claim 17, wherein the metal-based detergent includes the calcium-based detergent and the magnesium-based detergent, a calcium content based on the total amount of the lubricating oil composition is from 0.10% by mass to 0.20% by mass, and a magnesium content based on the total amount of the lubricating oil composition is from 0.03% by mass to 0.07% by mass.

* * * * *